US009740145B2

(12) United States Patent
Honda

(10) Patent No.: US 9,740,145 B2
(45) Date of Patent: Aug. 22, 2017

(54) IMAGE FORMING APPARATUS AND IMAGE FORMING METHOD FOR DETERMINING A TRANSFER VOLTAGE VALUE IN A TRANSFER SECTION THEREOF

(71) Applicant: Oki Data Corporation, Tokyo (JP)

(72) Inventor: Kentaro Honda, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/860,161

(22) Filed: Sep. 21, 2015

(65) Prior Publication Data

US 2016/0274502 A1 Sep. 22, 2016

(30) Foreign Application Priority Data

Mar. 18, 2015 (JP) ..... 2015-054254

(51) Int. Cl.
*G03G 15/16* (2006.01)

(52) U.S. Cl.
CPC ..... *G03G 15/1665* (2013.01); *G03G 15/1605* (2013.01); *G03G 15/1675* (2013.01)

(58) Field of Classification Search
CPC ..... G03G 15/1665; G03G 15/1675; G03G 15/6517; G03G 15/652; G03G 15/6523
(Continued)

(56) References Cited

U.S. PATENT DOCUMENTS 5,179,397 A * 1/1993 Ohzeki ..... G03G 15/1675 347/140
5,450,180 A * 9/1995 Ohzeki ..... G03G 15/1675 399/314
(Continued)

FOREIGN PATENT DOCUMENTS

GB 2345467 A 7/2000
JP 2009047833 A * 3/2009
(Continued)

OTHER PUBLICATIONS

English translation of JP-2015055672.*
English translation of JP 2009047833.*

*Primary Examiner* — Walter L Lindsay, Jr.
*Assistant Examiner* — Arlene Heredia Ocasio
(74) *Attorney, Agent, or Firm* — Rabin & Berdo, P.C.

(57) ABSTRACT

An image forming apparatus includes an transfer section including a transfer roller and a rotatable member and performing transfer processing in which it transfers a developer to a recording medium; a power source controller that applies a voltage to the transfer roller and measures a current value of a current that flows through the transfer roller and the rotatable member; and a main controller that calculates a first electrical resistance value between the transfer roller and the rotatable member in if the recording medium is absent between the transfer roller and the rotatable member and a second electrical resistance value between the transfer roller and the rotatable member if the recording medium is present between the transfer roller and the rotatable member on the basis of the current value measured by the power source controller, and determines a transfer voltage value for the transfer processing.

11 Claims, 12 Drawing Sheets

| | | ENVIRONMENTAL HUMIDITY Ha [%] | | | | |
|---|---|---|---|---|---|---|
| | | ~20 | 20~40 | 40~60 | 60~80 | 80~ |
| ENVIRONMENTAL TEMPERATURE Ta [°C] | ~10 | 1.20 | 1.05 | 0.90 | 0.75 | 0.60 |
| | 10~20 | 1.05 | 0.90 | 0.75 | 0.60 | 0.45 |
| | 20~30 | 0.90 | 0.75 | 0.60 | 0.45 | 0.30 |
| | 30~ | 0.75 | 0.60 | 0.45 | 0.30 | 0.15 |

UNIT : kV

(58) Field of Classification Search
USPC ..... 399/66
See application file for complete search history.

(56) References Cited

U.S. PATENT DOCUMENTS 5,682,575 A * 10/1997 Komori ..... G03G 15/1675 399/66
5,814,978 A * 9/1998 Ida ..... G03G 15/1675 323/282
5,887,220 A * 3/1999 Nagaoka ..... G03G 15/1675 399/43
5,903,798 A * 5/1999 Yokogawa ..... G03G 15/1675 399/314
5,953,556 A * 9/1999 Yamanaka ..... G03G 15/1675 399/66
6,070,025 A * 5/2000 Jeong ..... G03G 15/1675 399/66
6,393,227 B1 * 5/2002 Weaver ..... G03G 15/1675 399/45
6,456,804 B2 * 9/2002 Izawa ..... G03G 15/1675 399/66
2006/0198650 A1 * 9/2006 Nakaso ..... G03G 15/1675 399/66
2008/0124101 A1 * 5/2008 Takahashi ..... G03G 15/1675 399/44
2012/0315058 A1 * 12/2012 Shimizu ..... G03G 15/1645 399/66
2014/0086604 A1 * 3/2014 Miyazaki ..... G03G 15/1605 399/45
2014/0093259 A1 4/2014 Shiraki
2014/0147137 A1 * 5/2014 Miura ..... G03G 15/1675 399/45
2015/0277300 A1 * 10/2015 Hironaka ..... G03G 15/1675 399/66

FOREIGN PATENT DOCUMENTS

JP 2014-066919 A 4/2014
JP 2015055672 * 3/2015

* cited by examiner

FIG. 5

| | | ENVIRONMENTAL HUMIDITY Ha [%] | | | | |
|---|---|---|---|---|---|---|
| | | ~20 | 20~40 | 40~60 | 60~80 | 80~ |
| ENVIRONMENTAL TEMPERATURE Ta [°C] | ~10 | 0.16 | 0.15 | 0.14 | 0.13 | 0.12 |
| | 10~20 | 0.15 | 0.14 | 0.13 | 0.12 | 0.11 |
| | 20~30 | 0.14 | 0.13 | 0.12 | 0.11 | 0.10 |
| | 30~ | 0.13 | 0.12 | 0.11 | 0.10 | 0.09 |

UNIT: μA/mm

FIG. 6

| | | ENVIRONMENTAL HUMIDITY Ha [%] | | | | |
|---|---|---|---|---|---|---|
| | | ~20 | 20~40 | 40~60 | 60~80 | 80~ |
| ENVIRONMENTAL TEMPERATURE Ta [°C] | ~10 | 1.20 | 1.05 | 0.90 | 0.75 | 0.60 |
| | 10~20 | 1.05 | 0.90 | 0.75 | 0.60 | 0.45 |
| | 20~30 | 0.90 | 0.75 | 0.60 | 0.45 | 0.30 |
| | 30~ | 0.75 | 0.60 | 0.45 | 0.30 | 0.15 |

UNIT: kV

IMAGE FORMING APPARATUS AND IMAGE FORMING METHOD FOR DETERMINING A TRANSFER VOLTAGE VALUE IN A TRANSFER SECTION THEREOF

BACKGROUND OF THE INVENTION

Field of the Invention

The present invention relates to an image forming apparatus and an image forming method for forming an image on a recording medium.

Description of the Related Art

In general, an image forming apparatus includes a transfer section that transfers a toner image as a developer image onto a recording medium. For example, the image forming apparatus determines a transfer voltage value on the basis of a transfer current value in a state where a recording medium is absent in a transfer section. See Patent reference 1, Japanese patent application publication No. 2014-066919, for example.

It is desired for the image forming apparatus that image quality of the developer image transferred on the recording medium (image quality of an image fixed on the recording medium) is high, and the image forming apparatus is expected to be further enhanced in image quality.

SUMMARY OF THE INVENTION

An object of the present invention is to provide an image forming apparatus and an image forming method which are capable of enhancing image quality of the image formed on the recording medium.

According to an aspect of the present invention, an image forming apparatus includes: an transfer section including a transfer roller and a rotatable member facing the transfer roller, the transfer section performing transfer processing in which the transfer section transfers a developer to a recording medium passing between the transfer roller and the rotatable member; a power source controller that applies a voltage to the transfer roller, and measures a current value of a current that flows through the transfer roller and the rotatable member when the voltage is applied to the transfer roller; and a main controller that calculates a first electrical resistance value between the transfer roller and the rotatable member in a state where the recording medium is absent between the transfer roller and the rotatable member and a second electrical resistance value between the transfer roller and the rotatable member in a state where the recording medium is present between the transfer roller and the rotatable member on a basis of the current value measured by the power source controller, and determines a transfer voltage value for the transfer processing on a basis of the first electrical resistance value and the second electrical resistance value.

According to another aspect of the present invention, an image forming method for determining a transfer voltage value in a transfer section, the transfer section including a transfer roller and a rotatable member facing the transfer roller and performing transfer processing, in which the transfer section transfers a developer to a recording medium passing between the transfer roller and the rotatable member, includes: applying a voltage to the transfer roller, and measuring a current value of a current that flows through the transfer roller and the rotatable member when the voltage is applied to the transfer roller; calculating a first electrical resistance value between the transfer roller and the rotatable member in a state where the recording medium is absent between the transfer roller and the rotatable member on a basis of the measured current value of the current that flows through the transfer roller and the rotatable member; calculating a second electrical resistance value between the transfer roller and the rotatable member in a state where the recording medium is present between the transfer roller and the rotatable member; and determining a transfer voltage value for the transfer processing on a basis of the first electrical resistance value and the second electrical resistance value.

According to the image forming apparatus and the image forming method of the present invention, the transfer voltage is determined on the basis of the first electrical resistance value in a state where the recording medium is absent between the transfer roller and the rotatable member, and the second electrical resistance value in a state where the recording medium is present between the transfer roller and the rotatable member. Therefore, the image quality of the developer image transferred on the recording medium can be enhanced.

BRIEF DESCRIPTION OF THE DRAWINGS

In the drawings:

FIG. 5 is a diagram showing an example of a target current density table shown in FIG. 3 by a table form;

FIG. 6 is a diagram showing an example of a target voltage table shown in FIG. 3 by a table form;

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

Hereinafter, an embodiment of the present invention will be described in detail with reference to the accompanying drawings.

Configuration of the Present Embodiment

Figure 1:
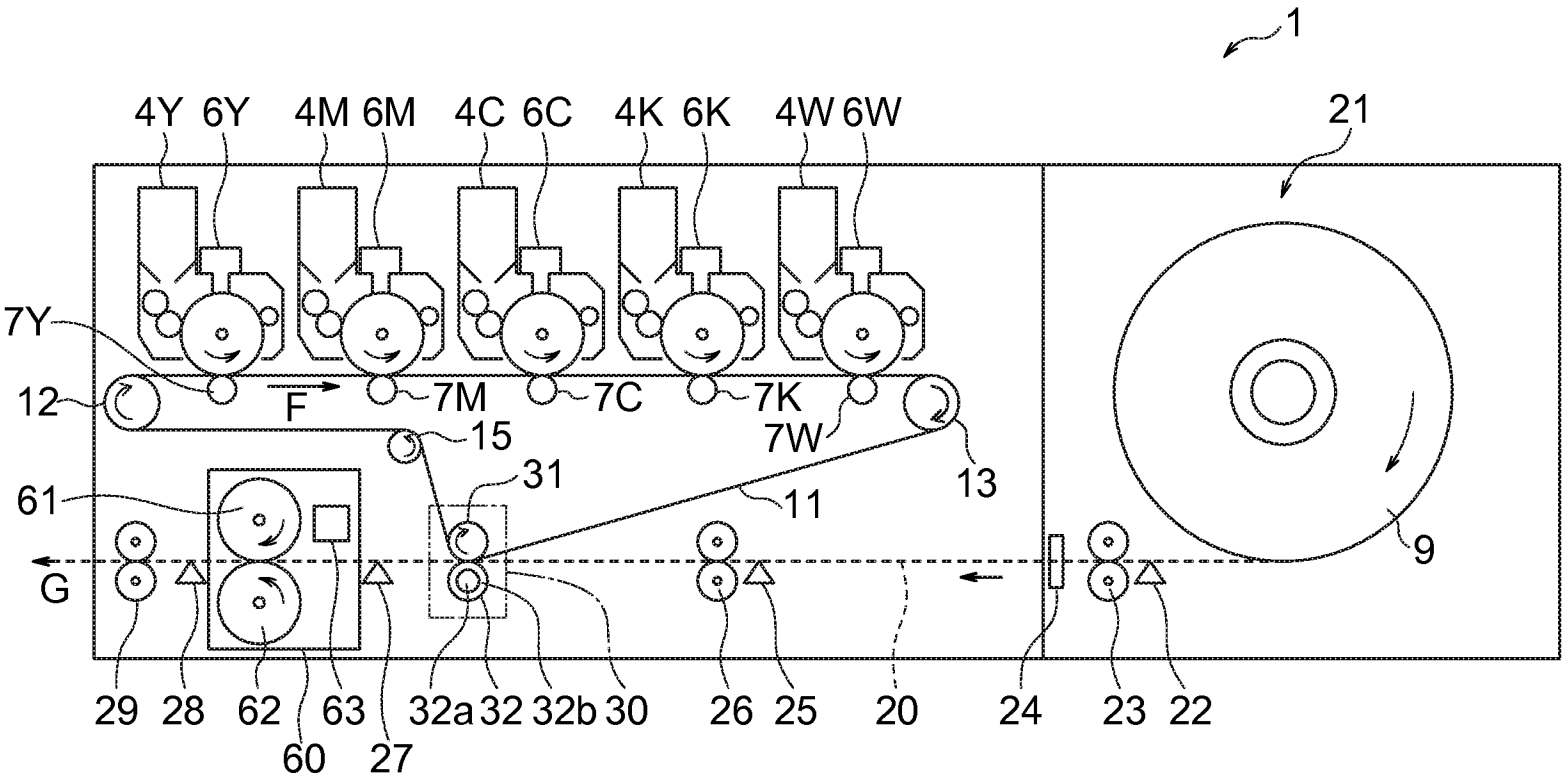
FIG. 1 is a diagram schematically showing a configuration example of an image forming apparatus according to an embodiment of the present invention.

FIG. 1 is a diagram showing a configuration example of an image forming apparatus according to an embodiment of the present invention. The image forming apparatus 1 functions as a printer which forms an image, by using an electrophotographic process, on a recording medium such as rolled paper formed by taking up belt-shaped paper in a form of a roll, for example. However, the recording medium may be paper except for rolled paper. The recording medium may be continuous paper, for example.

The image forming apparatus 1 includes five image drum (ID) units 4 (4Y, 4M, 4C, 4K, and 4W) as image forming units, five exposure units 6 (6Y, 6M, 6C, 6K, and 6W) as light sources, five primary transfer rollers 7 (7Y, 7M, 7C, 7K, and 7W), a transfer belt (intermediate transfer belt) 11, a drive roller 12, an idle roller 13, a secondary transfer backup roller 31 as a rotatable member, and a reversely bending roller 15. Furthermore, the image forming apparatus 1 includes a conveyance roller pair 23, a cutting unit (cutter) 24, a conveyance roller pair 26, a secondary transfer roller 32, a fixing unit 60, and a discharge roller 29. In addition, the image forming apparatus 1 includes a medium detecting sensor 22, a writing sensor 25, and discharge sensors 27 and 28. The secondary transfer roller 22 and the secondary transfer backup roller 31 are disposed to face each other with the transfer belt 11 therebetween, and constitutes the transfer section 30. Further, the number of the ID units 4 is not limited to five, and may be four or less and may be six or more. The number of the exposure units 6 is not limited to five, and may be four or less and may be six or more.

Each of the five ID units 4 forms a toner image. To be specific, the ID unit 4Y forms the toner image having a yellow color (Y), the ID unit 4M forms the toner image having a magenta color (M), the ID unit 4C forms the toner image having a cyan color (C), the ID unit 4K forms the toner image having a black color (K), and the ID unit 4W forms the toner image having a white color (W). The ID units 4Y, 4M, 4C, 4K, and 4W are disposed so as to face the transfer belt 11, and are arranged in tandem in this order in a moving direction F. The moving direction F is a direction in which part of the transfer belt 11 facing the ID units 4Y, 4M, 4C, 4K, and 4W moves.

Figure 2:
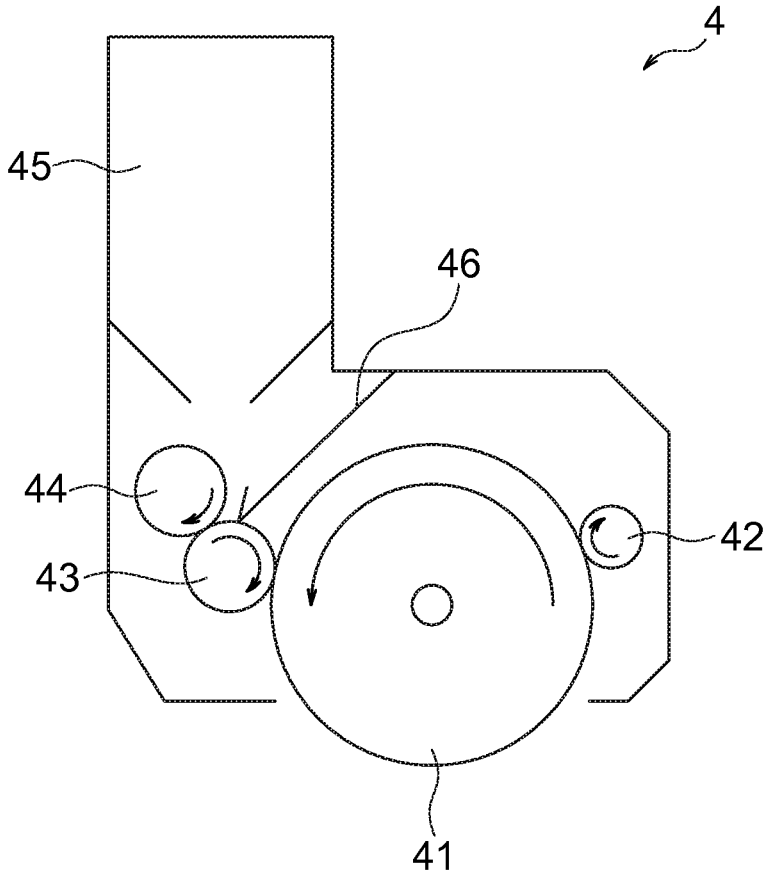
FIG. 2 is a diagram schematically showing a configuration example of an image forming unit (ID unit) shown in FIG. 1.

FIG. 2 is a diagram showing a configuration example of the ID unit 4. The ID unit 4 includes a photosensitive body (photosensitive drum) 41 as an image carrier, a charging roller 42, a developing roller 43, a supply roller 44, a toner container 45, and a toner blade 46.

The photosensitive body 41 is capable of carrying an electrostatic latent image on a surface thereof (surface layer portion). The photosensitive body 41 is rotated counterclockwise in FIG. 2 by driving power transmitted thereto from a photosensitive body motor as a power generating device (e.g., motor and the like) through a power transmission mechanism (e.g., gear and the like), for example. The surface of the photosensitive body 41 is uniformly charged with electricity by the charging roller 42. Furthermore, the photosensitive body 41 of the ID unit 4Y is exposed to light by the exposure unit 6Y, the photosensitive body 41 of the ID unit 4M is exposed to light by the exposure unit 6M, the photosensitive body 41 of the ID unit 4C is exposed to light by the exposure unit 6C, the photosensitive body 41 of the ID unit 4K is exposed to light by the exposure unit 6K, and the photosensitive body 41 of the ID unit 4W is exposed to light by the exposure unit 6W. In this way, the electrostatic latent images are formed on the surfaces of the photosensitive bodies 41, respectively.

In each ID unit, the charging roller 42 charges the surface (surface layer portion) of the photosensitive body 41 to negative polarity, for example. The charging roller 42 is disposed so as to contact with the surface (peripheral surface) of the photosensitive body 41, and is rotated clockwise in FIG. 2 with the rotation of the photosensitive body 41. As will be described later, a predetermined voltage is applied to the charging roller 42 by a high-voltage power source section (power source controller) 56.

In each ID unit, the developing roller 43 carries the toner charged to negative polarity. The developing roller 43 is disposed so as to contact with the surface (peripheral surface) of the photosensitive body 41, and is rotated clockwise in FIG. 2 by driving power transmitted thereto from the photosensitive body motor, for example. In each ID unit, the toner image corresponding to the electrostatic latent image is formed (developed) on the surface of the photosensitive body 41 by the toner as developer supplied from the developing roller 43. As will be described later, a predetermined voltage is supplied to the developing roller 43 by the high-voltage power source section 56.

The supply roller 44 charges the toner stored in the toner container 45 to negative polarity, and supplies the negatively charged toner to the developing roller 43. The supply roller 44 is disposed so as to contact with the surface (peripheral surface) of the developing roller 43, and is rotated clockwise in FIG. 2 by driving power transmitted thereto from the photosensitive body motor, for example. Thereby, in each ID unit 4, friction is generated between the surface of the supply roller 44 and the surface of the developing roller 43, and consequently, the toner is charged with the electricity by friction charging. As will be described later, a predetermined voltage is supplied to the supply roller 44 by the high-voltage power source section 56.

The toner container 45 stores the toner therein. To be specific, the toner container 45 in the ID unit 4Y stores the yellow (Y) toner therein, the toner container 45 in the ID unit 4M stores the magenta (M) toner therein, the toner container 45 in the ID unit 4C stores the cyan (C) toner therein, the toner container 45 in the ID unit 4K stores the black (K) toner therein, and the toner container 45 in the ID unit 4W stores the white (W) toner therein.

In each ID unit, the toner blade 46 forms a layer (toner layer) made of the toner on the surface of the developing roller 43 by touching the surface of the developing roller 43, and regulates (control or adjust) a thickness of the toner layer. The toner blade 46 is a plate-like elastic member (plate spring) made of, for example, stainless or the like, and is disposed so that a tip of the toner blade 46 touches the surface of the developing roller 43. As will be described later, a predetermined voltage is applied to the toner blade 46 by the high-voltage power source section 56.

The five exposure units 6 (FIG. 1) radiate spot lights of 600 dpi, for example, to the photosensitive bodies 41 of the five ID units 4, respectively. The exposure units 6 are LED-array-head exposure devices that emit light based on image data to be inputted, or laser exposure devices that irradiates the surfaces of the photosensitive bodies 41 with laser light based on the image data to be inputted. To be specific, the exposure unit 6Y radiates the spot light to the photosensitive body 41 of the ID unit 4Y, the exposure unit 6M radiates the spot light to the photosensitive body 41 of the ID unit 4M, the exposure unit 6C radiates the spot light to the photosensitive body 41 of the ID unit 4C, the exposure unit 6K radiates the spot light to the photosensitive body 41 of the ID unit 4K, and the exposure unit 6W radiates the spot light to the photosensitive body 41 of the ID unit 4W. Thereby, the photosensitive bodies 41 are exposed to light by the exposure units 6, respectively. As a result, the electrostatic latent images based on image data corresponding to respective colors are formed on the surfaces of the each photosensitive body 41, respectively.

The five primary transfer rollers 7 electrostatically transfer the toner images formed by the five ID units 4, respectively, onto an outer surface (a surface to be transferred) of the transfer belt 11. The primary transfer roller 7Y is disposed to face the photosensitive body 41 of the ID unit 4Y through the transfer belt 11, the primary transfer roller 7M is disposed to face the photosensitive body 41 of the ID unit 4M through the transfer belt 11, the primary transfer roller 7C is disposed to face the photosensitive body 41 of the ID unit 4C through the transfer belt 11, the primary transfer roller 7K is disposed to face the photosensitive body 41 of the ID unit 4K through the transfer belt 11, and the primary transfer roller 7W is disposed to face the photosensitive body 41 of the ID unit 4W through the transfer belt 11. As will be described later, predetermined voltages are applied to the primary transfer rollers 7 by the high-voltage power source section 56. Thereby, in the image forming apparatus 1, the toner images which have been formed by the ID units 4, respectively, are transferred (primary transfer) onto the outer surface of the transfer belt 11.

The transfer belt 11 is an endless elastic belt which includes, for example, a high-resistance semiconductor plastic film. The transfer belt 11 is tensioned (stretched) by the drive roller 12, the idle roller 13, the secondary transfer backup roller 31, and the reversely bending roller 15. Furthermore, the transfer belt 11 is stretched so as to move or rotate in the moving direction F in a circulating manner by rotation of the drive roller 12. In this case, the transfer belt 11 is stretched so as to move between the ID unit 4Y and the primary transfer roller 7Y, between the ID unit 4M and the primary transfer roller 7M, between the ID unit 4C and the primary transfer roller 7C, between the ID unit 4K and the primary transfer roller 7K, and between the ID unit 4W and the primary transfer roller 7W.

The drive roller 12 rotates the transfer belt 11 in a circulating manner. In the present embodiment, the drive roller 12 is disposed on an upstream side with respect to the five ID units 4 in the moving direction F, and is rotated clockwise in FIG. 1 by driving power transmitted thereto from a transfer belt motor as a power generating device (motor and the like) through a power transmission mechanism (gear and the like), for example. Thereby, the drive roller 12 rotates the transfer belt 11 in a circulating manner so that part of the transfer belt 11 facing the ID unit 4 moves in the moving direction F.

The idle roller 13 rotates clockwise in FIG. 1 following the circulatory rotation of the transfer belt 11. In the present embodiment, the idle roller 13 is disposed on a downstream side with respect to the five ID units 4 in the moving direction F.

The secondary transfer backup roller 31 rotates clockwise in FIG. 1 following the circulatory rotation of the transfer belt 11. For example, the secondary transfer backup roller 31 is made of a metal, and is electrically grounded. As will be described later, the secondary transfer backup roller 31 is disposed to face the secondary transfer roller 32 through a conveyance path 20 along which the recording medium 9 is conveyed and the transfer belt 11. The secondary transfer backup roller 31 and the secondary transfer roller 32 constitute a transfer section 30.

The reversely bending roller 15 rotates counterclockwise in FIG. 1 by following circulatory rotation of the transfer belt 11. The reversely bending roller 15 is disposed outside a path along which the transfer belt 11 rotates in a circulating manner between the drive roller 12 and the secondary transfer backup roller 31.

Moreover, the rolled paper feeder 21, the medium detecting sensor 22, the conveyance roller pair 23, the cutting unit 24, the writing sensor 25, the conveyance roller pair 26, the secondary transfer roller 32, the discharge sensors 27 and 28, the fixing unit 60, and the discharge roller 29 are disposed along the conveyance path 20 along which the recording medium 9 is conveyed.

In the rolled paper feeder 21, the recording medium 9 as the rolled paper is set. The medium detecting sensor 22 is a sensor which detects the recording medium 9 supplied from the rolled paper feeder 21. The conveyance roller pair 23 includes a pair of rollers with the conveyance path 20 put between the rollers, and conveys the recording medium 9 so that the recording medium 9 supplied from the rolled paper feeder 21 reaches a suitable position at a suitable timing. The cutting unit 24 cuts the recording medium 9 as the rolled paper. The cutting unit 24, for example, cuts the recording medium 9 when a power source of the image forming apparatus 1 is turned ON, and when a user operates the image forming apparatus 1. The writing sensor 25 is a sensor which detects that the recording medium 9 has passed therethrough. The conveyance roller pair 26 includes a pair of rollers with the conveyance path 20 put between the rollers, and conveys the recording medium 9 along the conveyance path 20.

The secondary transfer roller 32 transfers the toner image on the outer surface of the transfer belt 11 onto the outer surface of the recording medium 9 passing between the secondary transfer roller 32 and the secondary transfer backup roller 31. The secondary transfer roller 32 includes a shaft 32*a* made of, for example, a metal, and a semiconductive urethane rubber layer 32*b* which covers an outer periphery (surface) of the shaft 32*a*. The secondary transfer roller 32 is disposed to face the secondary transfer backup roller 31 through the transfer belt 11 and the conveyance path 20. As will be described later, a positive transfer voltage (transfer voltage value Vtr for transfer processing) is supplied to the shaft 32*a* of the secondary transfer roller 32 through a resistance element 39 by a voltage generator (power supply) 56*a*, for example. Thereby, in the image forming apparatus 1, the toner image on the surface (outer surface) to be transferred of the transfer belt 11 is transferred (secondary transfer) onto a surface (an upper surface in FIG. 1) to be transferred of the recording medium 9.

The discharge sensor 27 is a sensor which detects that the recoding medium 9 has passed through the transfer section 30.

The fixing unit 60 fixes the toner image transferred onto the recoding medium 9 by applying heat and pressure. The fixing unit 60 includes a heat roller 61, a pressure roller 62, and a temperature sensor 63. The heat roller 61 includes, for example, a heater such as a halogen lamp therein, and applies heat to the toner on the recording medium 9. The pressure roller 62 is disposed so as to form a pressure portion between itself and the heat roller 61, and applies the pressure to the toner on the recording medium 9. The temperature sensor 63 detects surface temperatures of the heat roller 61 and the pressure roller 62, for example. Thus, in the fixing unit 60, the toner on the recording medium 9 is heated, melted, and pressed. As a result, the toner image is fixed on the recording medium 9.

The discharge sensor 28 is a sensor which detects that the recording medium 9 has passed through the fixing unit 60.

The discharge sensor 29 includes a pair of rollers with the conveyance path 20 put between the rollers, and discharges the recording medium 9 to outside of the image forming apparatus 1.

Figure 3:
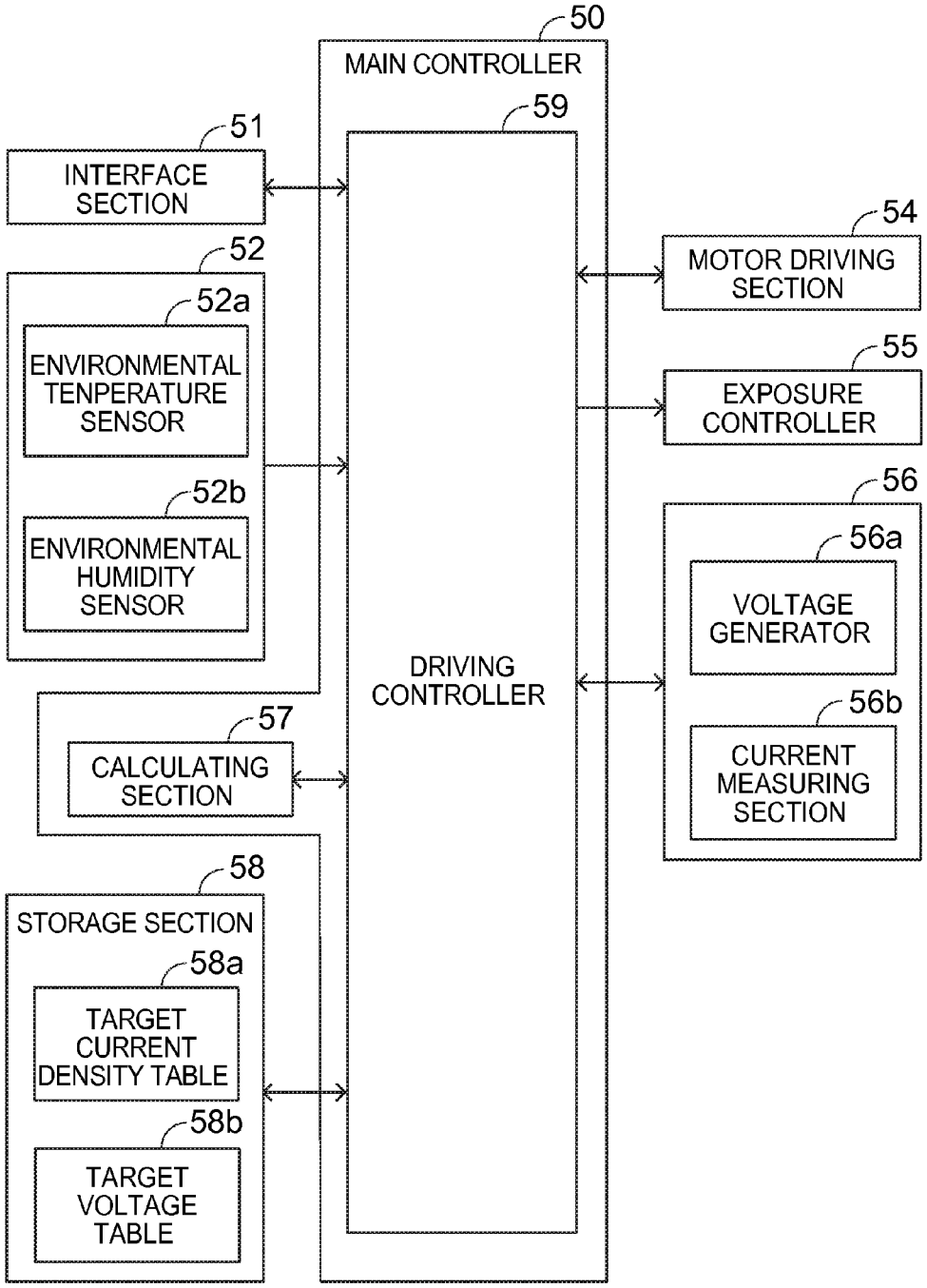
FIG. 3 is a block diagram schematically showing a configuration example of a control system in the image forming apparatus shown in FIG. 1.

FIG. 3 is a block diagram schematically showing an example of a control system in the image forming apparatus 1. The image forming apparatus 1 includes an interface section 51, an environmental detector 52, a motor driving section (a motor driver) 54, an exposure controller 55, the high-voltage power source section 56, a storage section (memory) 58, and a main controller 50. The environmental detector 52 includes an environmental temperature sensor 52*a* and an environmental humidity sensor 52*b*. The main controller 50 includes a calculating section 57 and a driving controller 59.

The interface section 51 receives print data from a host computer as a host device and exchanges various kinds of control signals between itself and the host computer, for example. The environmental detector 52 (specifically, environmental temperature sensor 52*a*) detects an environmental temperature Ta of the image forming apparatus 1. The environmental detector 52 (specifically, environmental humidity sensor 52*b*) detects an environmental humidity Ha of the image forming apparatus 1. The environmental temperature sensor 52*a* and the environmental humidity sensor 52*b* are disposed inside or outside a housing of the image forming unit 1, for example. It is preferable that the environmental detector 52 detects at least one of the environmental temperature and the environmental humidity in the transfer section 30. The motor driving section 54 controls operation of the motors as power generating devices in the image forming apparatus 1. Thus, the motor driving section 54 controls the operation of each motor, thereby rotating the photosensitive bodies 41, the drive roller 12, the conveyance roller pair 23, the conveyance roller pair 26, the heat roller 61, and the discharge roller 29. The exposure controller 55 controls exposure operation in the exposure units 6.

The high-voltage power source section 56 supplies the voltages to the charging roller 42, the developing roller 43, the supply roller 44, and the toner blade 46 of each ID unit 4, each transfer roller 7, and the secondary transfer roller 32 of the transfer section 30. The high-voltage power source section 56 includes the voltage generator 56*a* and a current measuring section 56*b*. The high-voltage power source section 56 generates the transfer voltage of the transfer voltage value Vtr, and supplies (applies) the transfer voltage to the shaft 32*a* of the secondary transfer roller 32 through the resistance element 39 (which will be described later). To be specific, the voltage generator 56*a* generates the transfer voltage of the transfer voltage value Vtr, and applies the transfer voltage to the shaft 32*a* of the secondary transfer roller 32. The high-voltage power source section 56 measures a value (transfer current value) Itr of a transfer current in the transfer section 30. To be specific, the current measuring section 56*b* measures the current value (transfer current value) Itr of the transfer current that flows through the secondary transfer roller 32 and the secondary transfer backup roller 31 when the voltage is applied to the secondary transfer roller 32.

Figure 4:
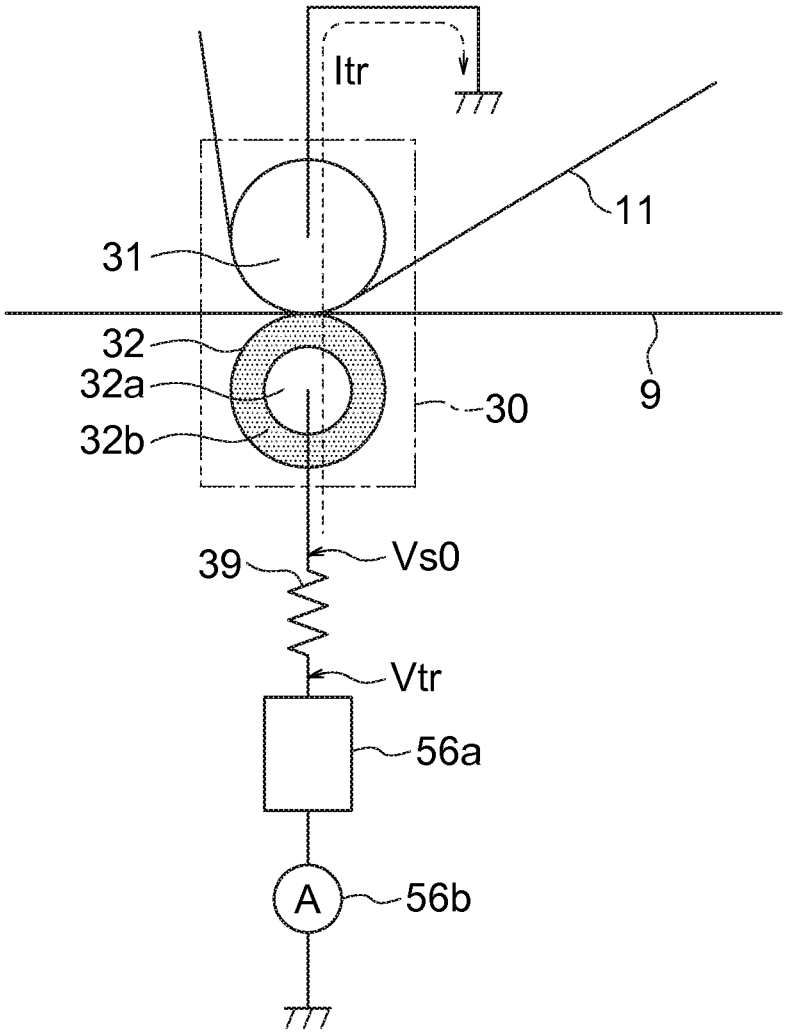
FIG. 4 is a diagram schematically showing supply of a transfer voltage to a transfer section shown in FIG. 1.

FIG. 4 is a diagram schematically showing the operation for supplying the transfer voltage of the transfer voltage value Vtr to the transfer section 30. An output terminal of the voltage generator 56*a* is connected to the shaft 32*a* of the secondary transfer roller 32 through the resistance element 39.

The resistance element 39 has a resistance value R of, for example, several MΩ (megaohms), and limits a current which flows through the transfer section 30. A ground terminal of the voltage generator 56*a* is grounded through the current measuring section 56*b*.

When the transfer section 30 intends to transfer the toner image on the transfer belt 11 to the recording medium 9, the voltage generator 56*a* generates the transfer voltage of the transfer voltage value Vtr. The generated transfer voltage is supplied to the secondary transfer roller 32 through the resistance element 39. Thereby, the transfer current of the transfer current value Itr flows through the resistance element 39, the shaft 32*a*, the urethane rubber layer 32*b*, the recording medium 9, the transfer belt 11, and the secondary transfer backup roller 31 in this order, for example. In this case, since the resistance values of these elements are changed depending on, for example, the environmental temperature and the environmental humidity, the transfer current value Itr may be changed, so that the transfer characteristics of the toner image in the transfer section 30 may be changed. In the image forming apparatus 1, as will be described later, the transfer voltage value Vtr is determined by the main controller 50 so that a current density of the current that flows through the recording medium 9, and an electric potential difference between a voltage value (electric potential) of a front surface and a voltage value (electric potential) of a back surface in the recording medium 9 are kept approximately constant irrespective of the temperature and the humidity (for example, corresponding to the environmental temperature Ta and the environmental humidity Ha) of the transfer section 30. As a result, in the image forming apparatus 1, the satisfactory transfer characteristics are obtained irrespective of the temperature and the humidity (for example, corresponding to the environmental temperature Ta and the environmental humidity Ha).

The main controller 50 (specifically, calculating section 57) calculates the transfer voltage value Vtr. For example, it is preferable that the calculating section 57, as will be described later, obtain the transfer voltage value Vtr on the basis of the environmental temperature Ta, the environmental humidity Ha, and the transfer current value Itr that flows through the transfer section 30.

For example, the storage section 58 is a nonvolatile memory, and stores a target current density table 58*a* and a target voltage table 58*b*.

FIG. 5 is a diagram showing an example of the target current density table 58*a* by a table form. The target current density table 58*a* represents a preferable current density (target medium current density Jp) of such a current that flows through the recording medium 9 that the transfer section 30 can satisfactorily transfer the toner image onto the recording medium 9. The target medium current density Jp is a current value per unit length in a width direction (in a depth direction in FIG. 1, that is, in a direction orthogonal to the conveyance direction of the recording medium 9) of the recording medium 9. A unit of the target medium current density Jp is μA/mm in the present embodiment. The target current density table 58*a* shows the target medium current densities Jp which can realize the satisfactory transfer in each of environmental conditions indicated by the various environmental temperatures Ta (temperature range) and the various environmental humidity Ha (humidity range).

FIG. 6 is a diagram showing an example of the target voltage table 58*b* by a table form. The target voltage table 58*b* shows the preferable electric potential difference (target medium voltage value Vp), between the voltage value (electric potential) of the front surface and the voltage value (electric potential) of the back surface in the recording medium 9, with which the transfer section 30 can satisfactorily transfer the toner image onto the recording medium 9. A unit of the target medium voltage value Vp is kV in this example. The target voltage table 58*b* shows the target medium voltage values Vp which can realize the satisfactory transfer in each of environmental conditions indicated by the various environmental temperatures Ta (temperature range) and the various environmental humidity Ha (humidity range).

Further, FIGS. 5 and 6 are each merely an example, and the target current density table 58*a* and the target voltage table 58*b* are not limited to the tables shown in FIGS. 5 and 6. For example, the value of the target medium current density Jp, and the value of the target medium voltage value Vp may be changed depending on print speed or the like. In addition, for example, the whole temperature range and the whole humidity range may be more finely divided (using narrower environmental temperature ranges and narrower environmental humidity ranges as each temperature range and each humidity range in the target current density table 58*a* and the target voltage table 58*b*) to set the target medium current density Jp and the target medium voltage value Vp. Moreover, for example, the whole temperature range and the whole humidity range may also be more roughly divided (using a wider environmental temperature range and a wider environmental humidity range as each temperature range and each humidity range in the target current density table 58*a* and the target voltage table 58*b*) to set the target medium current density Jp and the target medium voltage value Vp. Moreover, a plurality of target current density tables 58*a* and a plurality of target voltage tables 58*b* may also be provided, and one of the plurality of target current density tables 58*a* may be selected and one of the plurality of target voltage tables 58*b* may be selected depending on, for example, a kind of recording medium 9 to be used.

The driving controller 59 controls each block (each configuration) shown in FIG. 3. The driving controller 59 controls the whole operation of the image forming apparatus 1 on the basis of detection results of various sensors shown in FIG. 1.

Further, the calculating section 57 and the driving controller 59, for example, can be configured so as to include a microprocessor, a Read Only Memory (ROM), a Random Access Memory (RAM), an Input/Output (input and output) port, a timer, and so on.

Here, the secondary transfer roller 32 corresponds to a concrete example of "a transfer roller". The secondary transfer backup roller 31 corresponds to a concrete example of "a rotatable member". The toner corresponds to a concrete example of "a developer". The five ID units 4, the five exposure units 6, the five primary transfer rollers 7, the transfer belt 11, and the transfer section 30 correspond to a concrete example of "an image forming section". The calculating section 57 and the driving controller 59 correspond to a concrete example of "a main controller". The environmental temperature sensor 52*a* and the environmental humidity sensor 52*b* correspond to a concrete example of "an environmental detecting section".

Operation of the Present Embodiment

Next, operation and function of the image forming apparatus 1 of the present embodiment will be described.

Image Forming Operation

Firstly, an outline of the whole operation of the image forming apparatus 1 will be described with reference to FIGS. 1 to 3. In the image forming apparatus 1, when the driving controller 59 has received the print data from the host computer through the interface section 51, firstly, the driving controller 59 operates the heater of the heat roller 61 by controlling the fixing unit 60.

When a temperature of the fixing unit 60 detected by the temperature sensor 63 has reached a temperature suitable for the fixing operation, the driving controller 59 controls the motor driving section 54, thereby rotating the photosensitive bodies 41 of the ID units 4. Furthermore, the driving controller 59 controls the motor driving section 54 so that a moving speed (linear speed) of outer surfaces of each photosensitive body 41 in a circumferential direction becomes the same level (substantially the same) as the conveyance speed of the recording medium 9 at printing. Concurrently therewith, the driving controller 59 controls the motor driving section 54, thereby rotating the drive roller 12, the conveyance roller pair 23, the conveyance roller pair 26, the heat roller 61, and the discharge roller 29. Furthermore, the driving controller 59 performs the control so that the conveyance speed becomes the same level (substantially the same) as the conveyance speed of the recording medium 9 at the printing.

In addition, the driving controller 59 controls the high-voltage power source section 56, thereby starting to rotate the photosensitive body 41 in such a way, and causes the high-voltage power source section 56 to apply a negative voltage (for example, −1150 V) to the charging roller 42. As a result, the photosensitive body 41 is uniformly charged to the negative voltage (for example, −700 V). In addition, the driving controller 59 causes the high-voltage power source section 56 to apply a negative voltage (for example, −300 V) to the developing roller 43 by controlling the high-voltage power source section 56. Furthermore, when the photosensitive body 41 is rotated in the ID unit 4 and a part which is negatively charged of the photosensitive body 41 has reached a nip portion between the photosensitive body 41 and the primary transfer roller 7, the ID unit 4 becomes a state of being able to perform the printing.

Next, the driving controller 59 causes the motor driving section 54 to convey the recording medium 9 from the rolled paper feeder 21 to a predetermined position along the conveyance path 20 on the basis of the detection result by the medium detecting sensor 22 by controlling the motor driving section 54. Furthermore, the driving controller 59 obtains a timing at which a front end of the recording medium 9 reaches a nip portion between the secondary transfer backup roller 31 and the secondary transfer roller 32 in the transfer section 30 on the basis of a detection result by the writing sensor 25.

Next, the driving controller 59 generates the image data the pieces of which the ID unit 4 should form on the basis of the print data. Furthermore, the driving controller 59 causes the exposure controller 55 to expose the photosensitive bodies 41 of the ID units 4 by using the exposure units 6 (causing the exposure units 6 to emit light) by controlling the exposure controller 55 at a timing (timing based on a recording-medium reaching timing) in consideration of the timing (recording-medium reaching timing) at which the front end of the recording medium 9 reaches the nip portion. Thereby, in each ID unit 4, an electric potential of the exposed portion of the surface of the photoreceptor 41 becomes about 0 V, and the electrostatic latent image is formed.

The driving controller 59 causes the high-voltage power source section 56 to apply a negative voltage (for example, −400 V) to the supply roller 44, and to apply a negative voltage (for example, −400 V) to the toner blade 46 by controlling the high-voltage power source section 56. Thereby, the supply roller 44 charges the toner to negative polarity, and supplies the charged toner to the developing roller 43. The toner supplied to the developing roller 43 is carried on the surface of the developing roller 43, and the thickness of the toner carried on the surface of the developing roller 43 is regulated by the toner blade 46, and the toner is charged to negative polarity. Since the electric potential of the exposed part of the surface of the photosensitive body 41 is about 0 V, the toner charged to negative polarity on the developing roller 43 is moved from the developing roller 43 to the exposed part of the surface of the photosensitive body 41 by Coulomb's force. Thereby, in the photosensitive body 41, a visible image which is the toner image is formed from the electrostatic latent image (that is, developing).

The driving controller 59 causes the high-voltage power source section 56 to apply the positive voltage (for example, +1,500 V) to each transfer roller 7 by controlling the high-voltage power source section 56. Thereby, the toner charged to negative polarity on the photosensitive body 41 is moved to the transfer belt 11 from the photosensitive body 41 by the Coulomb's force.

The driving controller 59 causes the high-voltage power source section 56 to supply the positive transfer voltage value Vtr (positive transfer voltage) determined by the calculating section 57 to the secondary transfer roller 32 through the resistance element 39 by controlling the high-voltage power source section 56. Thereby, the toner charged to negative polarity on the transfer belt 11 is moved to the recording medium 9 from the transfer belt 11 by the Coulomb's force.

The toner on the recording medium 9 is melted by being heated, and pressed by the fixing unit 60. As a result, the toner image is fixed on the recording medium 9.

Determining Operation of Transfer Voltage Value

Next, a determining operation of the transfer voltage value Vtr which is to be applied to the secondary transfer roller 32 will be described in detail.

Figure 7:
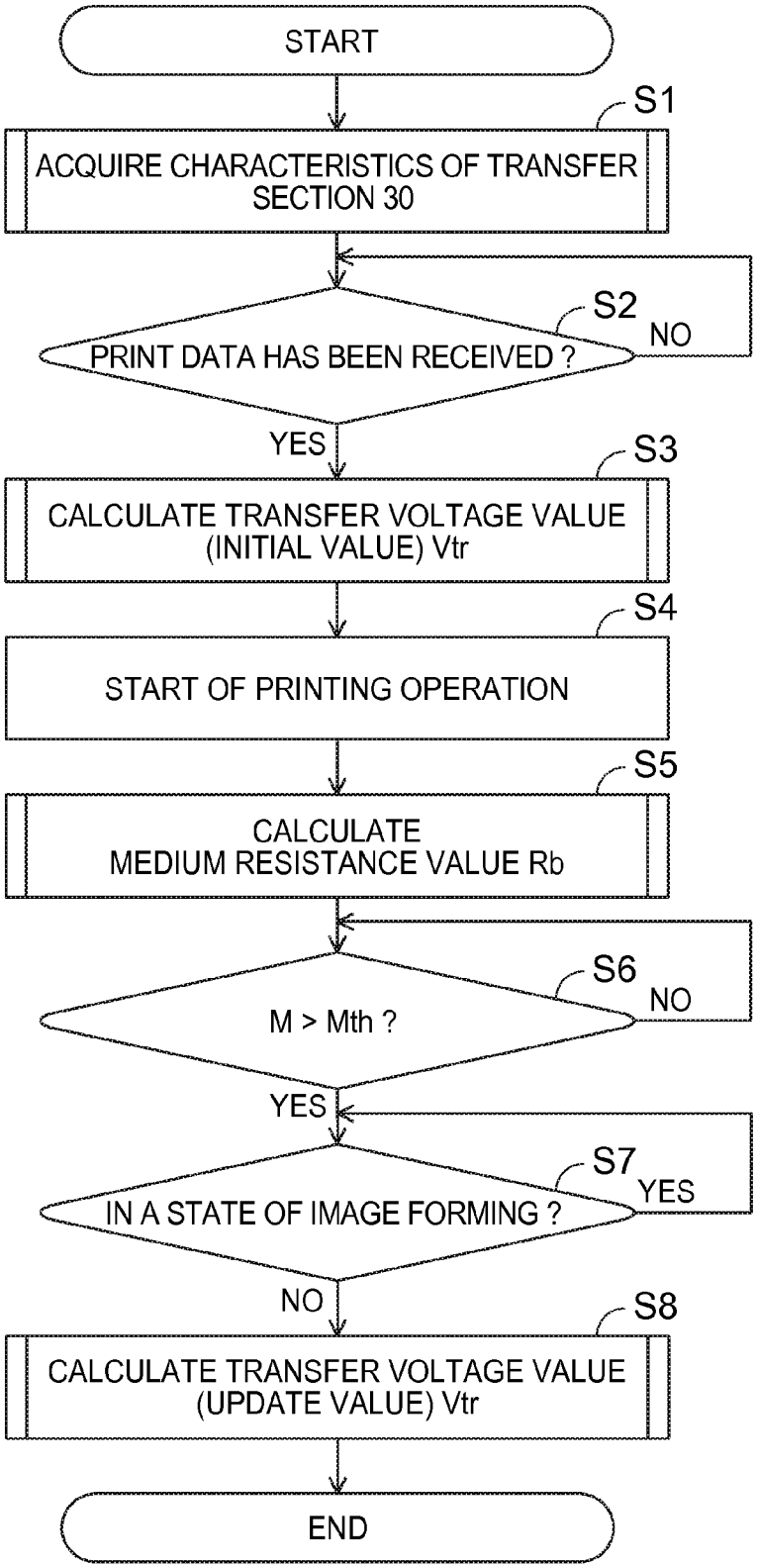
FIG. 7 is a flowchart showing an example of an operation of determining an initial value and an update value as the transfer voltage value in the image forming apparatus shown in FIG. 1.

FIG. 7 is a flowchart showing a determining operation of an initial value and an updated value of the transfer voltage value Vtr. The image forming apparatus 1, firstly, acquires electrical characteristics of the transfer section 30 in a state where the recording medium 9 is absent in the transfer section 30 after the power source has been turned ON. Furthermore, when having received the print data, the image forming apparatus 1 determines the transfer voltage value Vtr, and starts to perform the printing. After that, when a length in the conveyance direction ("G" direction in FIG. 1) of the recording medium 9 that is printed the image (hereinafter, also referred to as a printing distance) M has exceeded a predetermined reference length (hereinafter, also referred to as a reference distance) Mth, the image forming apparatus 1 (specifically, the main controller 50) determines the transfer voltage value Vtr again. Hereinafter, this operation will be described in detail. An updating operation that again determines the transfer voltage value Vtr is executed every time the printing distance M of the immediately preceding updating operation exceeds a reference distance Mth.

Firstly, when the power source of the image forming apparatus 1 has been turned ON, the image forming apparatus 1 acquires the electrical characteristics of the transfer section 30 (step S1).

Acquisition of Electrical Characteristics of Transfer Section 30

Figure 8:
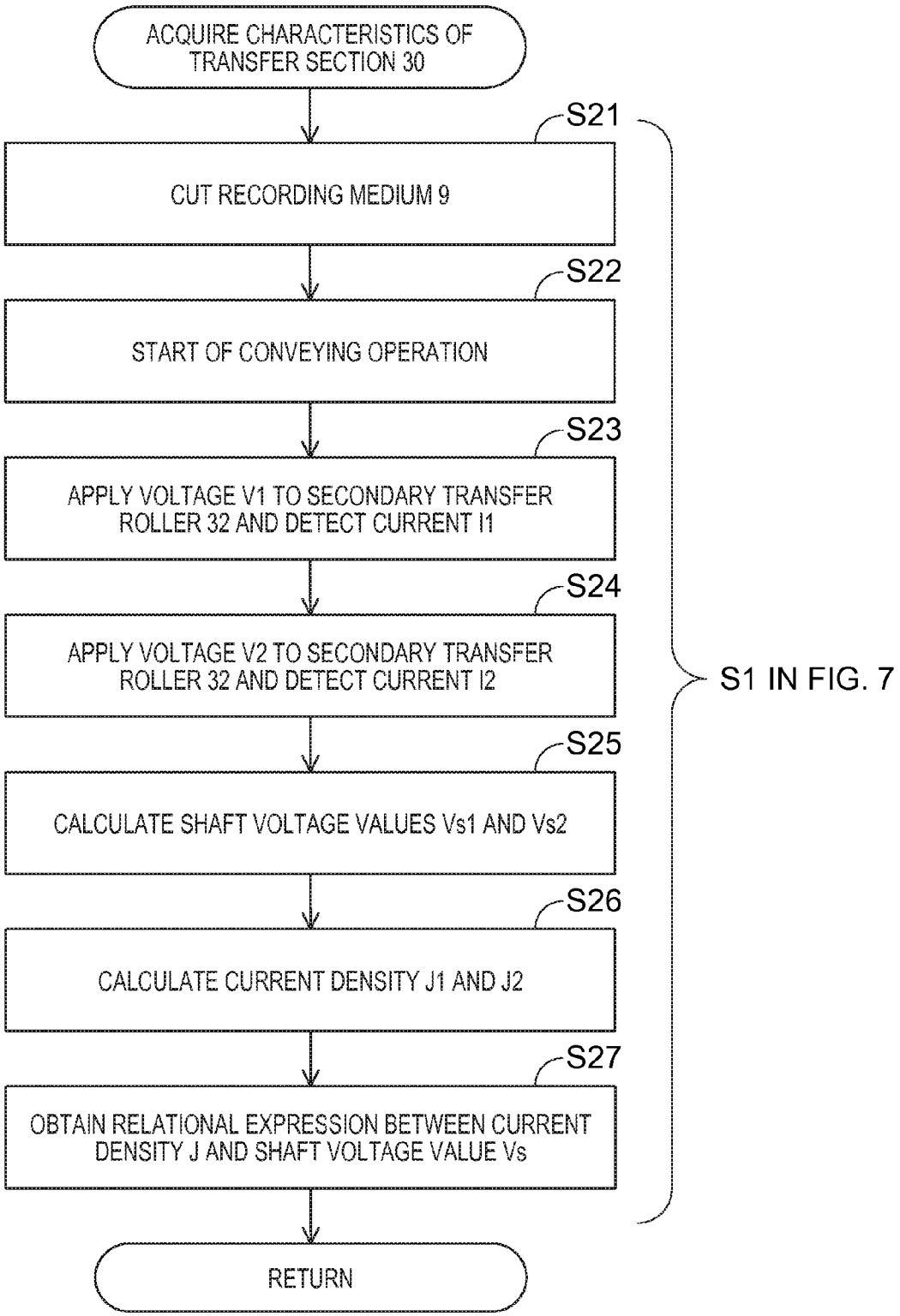
FIG. 8 is a flowchart showing an example of processing in an acquiring step of electrical characteristics of a transfer section shown in FIG. 7.

FIG. 8 is a flowchart showing an acquiring step of the electrical characteristics of the transfer section 30.

Firstly, the driving controller 59 of the image forming apparatus 1 causes the cutting unit 24 to cut the recording medium 9 by controlling the cutting unit 24 (step S21). Furthermore, the image forming apparatus 1 starts to perform a conveying operation (step S22). To be specific, the driving controller 59 rotates the drive roller 12, the conveyance roller pair 26, the heat roller 61, and the discharge roller 29 by controlling the motor driving section 54. The transfer section 30 is in a state where the recording medium 9 is absent therein at the time of starting of the conveying operation.

Next, the image forming apparatus 1 supplies (applies) a voltage V1 to the secondary transfer roller 32 through the resistance element 39 to detect a current I1 (step S23). To be specific, the voltage generator 56*a* of the high-voltage power source section 56 generates the voltage V1 on the basis of an instruction sent from the driving controller 59. Furthermore, the current measuring section 56*b* detects the current I1, and supplies the detection result to the driving controller 59.

Next, the image forming apparatus 1 supplies (applies) a voltage V2 different from the voltage V1 to the secondary transfer roller 32 through the resistance element 39 to detect a current I2 (step S24). To be specific, the voltage generator 56*a* generates the voltage V2 on the basis of an instruction issued from the driving controller 59. Furthermore, the current measuring section 56*b* detects the current I2, and supplies the detection result to the driving controller 59.

Further, although in this example, the currents I1 and I2 are detected one time each, a detecting method for detecting the currents I1 and I2 is not limited thereto. For example, it may also be adopted that the current I1 is detected multiple times to obtain an average value thereof, and the current I2 is also detected multiple times to obtain an average value thereof.

Next, the calculating section 57 of the image forming apparatus 1 calculates a value of shaft voltage (shaft voltage value) Vs (for example, shaft voltage values Vs1 and Vs2) in the shaft 32*a* at the time of supply of the voltages in the steps S23 and S24 (step S25). That is to say, the voltage generator 56*a* supplies the voltage to the secondary transfer roller 32 through the resistance element 39. Therefore, the shaft voltage values Vs1 and Vs2 in the shaft 32*a* is different from the voltages V1 and V2 which the voltage generating portion 56*a* generates, for example. The shaft voltage values Vs1 and Vs2 can be expressed as follows by using the resistance value R of the resistance element 39:

$$Vs1=V1-R\times I1 \tag{1a}$$

$$Vs2=V2-R\times I2 \tag{1b}$$

The calculating section 57 calculates the shaft voltage values Vs1 and Vs2 by using expressions (1a) and (1b).

Next, the calculating section 57 calculates a current density J (for example, current density J1 and J2) in the transfer section 30 at the time of supply of the voltages in steps S23 and S24 (step S26). Here, the current densities J1 and J2 are each the current value per unit length in a length direction (a depth direction in FIG. 1) of the secondary transfer roller 32, and a unit of the current densities J1 and J2, for example, is μA/mm. When a length of the secondary transfer roller 32 is represented by L mm, the current densities J1 and J2 can be expressed as follows:

$$J1=I1/L \tag{2a}$$

$$J2=I2/L \tag{2b}$$

The calculating section 57 calculates the current densities J1 and J2 by using expressions (2a) and (2b).

Next, the calculating section 57 obtains a relational expression between the current density J and the shaft voltage value Vs by linear approximation, for example (step S27). The current density J can be expressed as follows by using the shaft voltage value Vs, and coefficients a and b:

$$J=a\times Vs+b \tag{3a}$$

$$a=(J2-J1)/(Vs2-Vs1) \tag{3b}$$

$$b=(J1\times Vs2-J2\times Vs1)/(Vs2-Vs1) \tag{3c}$$

The calculating section 57 calculates the coefficients a and b by using the shaft voltage values Vs1 and Vs2 calculated in step S25 (expressions (1a) and (1b)), the current densities J1 and J2 calculated in step S26 (expressions (2a) and (2b)), and expressions (3a), (3b), and (3c).

Further, the operation for acquiring the electrical characteristics of the transfer section 30 (steps S21 to S27) may be performed at least once after turn-ON of the power source, and before start of the printing.

As stated above, the processing flow (step S1 in FIG. 7 and FIG. 8) for acquisition of the electrical characteristics of the transfer section 30 ends.

Next, as shown in FIG. 7, the driving controller 59 of the image forming apparatus 1 confirms whether or not the print data has been received (step S2). When the print data has not been yet received ("No" in step S2), the processing flow returns back to step S2. Furthermore, step S2 is repeated until the print data is received.

Furthermore, when the print data has been received ("Yes" in step S2), the image forming apparatus 1 calculates the transfer voltage value (initial value) Vtr (step S3).

Calculation of Transfer Voltage Value (Initial Value) Vtr

Figure 9:
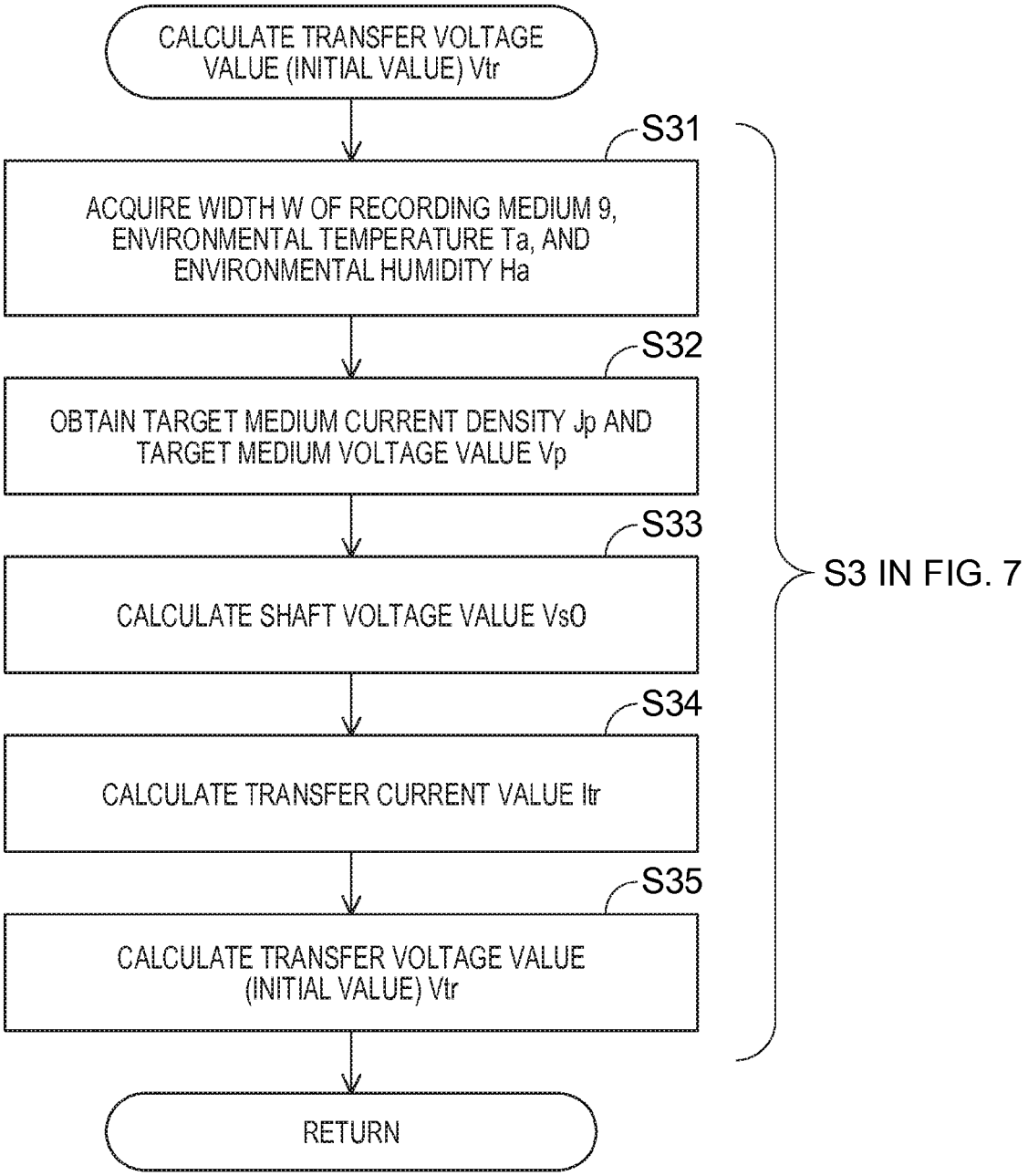
FIG. 9 is a flowchart showing an example of processing in a calculating step of the initial value as the transfer voltage value shown in FIG. 7.

FIG. 9 is a flowchart showing a calculating step (step S3 in FIG. 7) of the transfer voltage value (initial value) Vtr.

Firstly, the driving controller 59 of the image forming apparatus 1 acquires information concerning a width W (for example, a unit of the width W is mm) of the recording medium 9, contained in the print data, and also acquires the environmental temperature Ta (for example, a unit of the environmental temperature Ta is ° C.) detected by the environmental temperature sensor 52*a*, and the environmental humidity Ha (for example, relative humidity [%]) detected by the environmental humidity sensor 52*b* (step S31). Further, although in this example, the width W of the recording medium 9 is acquired on the basis of the print data, the acquiring method of the information concerning the width W is by no means limited thereto. For example, in a case where the image forming apparatus 1 includes a medium-width detector which detects the width W of the recording medium 9 set in the rolled paper feeder 21, the driving controller 59 may acquire the information concerning the width W from the medium-width detector.

Next, the calculating section 57 of the image forming apparatus 1 obtains the target medium current density Jp and the target medium voltage value Vp (step S32). To be specific, the calculating section 57 obtains the target medium current density Jp and the target medium voltage value Vp from the target current density table 58*a* and the target voltage table 58*b* by using the environmental temperature Ta and the environmental humidity Ha which were acquired in step S31.

Next, the calculating section 57 calculates a shaft voltage value Vs0 with which the target medium current density Jp and the target medium voltage value Vp which were obtained in step S32 can be realized (step S33).

Figure 10:
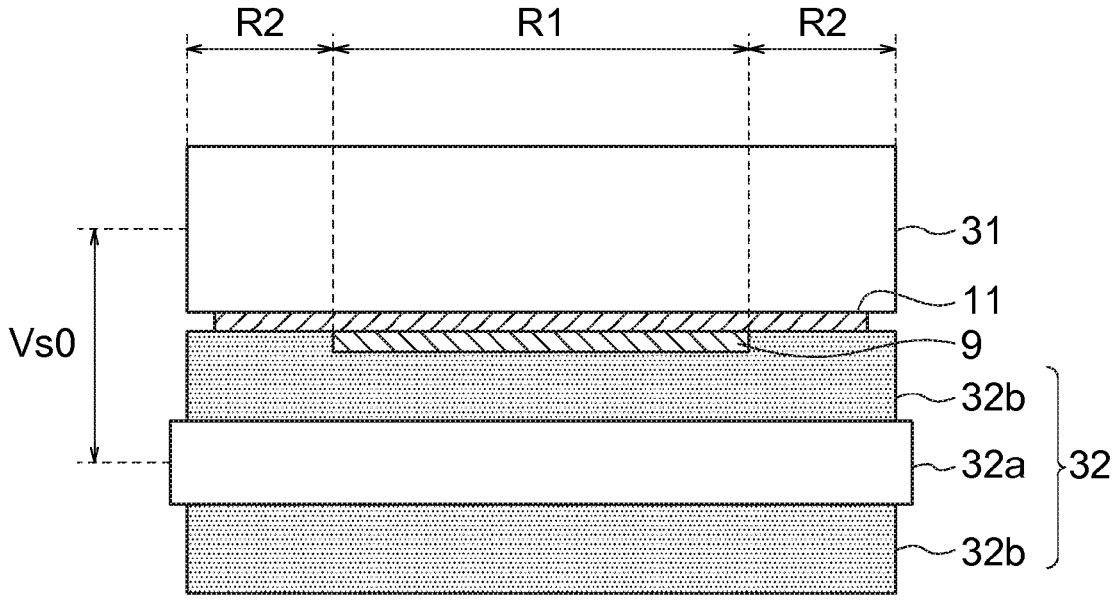
FIG. 10 is a diagram schematically showing a state of the transfer section when it is viewed from upstream side of a conveyance direction of the recording medium.

FIG. 10 is a diagram schematically showing a state of the transfer section 30 when it is viewed from upstream side of the conveyance direction of the recording medium 9 shown in FIG. 1. In FIG. 10, an example in a case where the recording medium 9 is present in the transfer section 30 is shown. To be specific, the recording medium 9 is held between the transfer belt 11 and the urethane rubber layer 32*b* of the secondary transfer roller 32. In FIG. 10, in the length direction of the secondary transfer roller 32 (in a transverse direction in FIG. 10, and in a direction of a rotational center axis of the secondary transfer roller 32), a region in which the recording medium 9 is held is shown as a region R1, while a region in which no recording medium 9 is held is shown as a region R2. In this example, since the secondary transfer backup roller 31 is grounded, the shaft voltage value is equal to a voltage (shaft voltage value) Vs0 developed across the secondary transfer backup roller 31 and the shaft 32*a*.

We will now focus on the region R1. The shaft voltage value Vs0 can be expressed as follows:

$$Vs0=Vin+Vp \tag{4}$$

where a voltage value Vin is a voltage component (electric potential difference) resulting from the existence of the transfer belt 11 and the urethane rubber layer 32*b* in the shaft voltage value Vs0. That is to say, a first term of the right side of expression (4) shows the voltage component (electric potential difference) caused by a contribution of the transfer belt 11 and the urethane rubber layer 32*b*. A second term of the right side of expression (4) is the voltage component (electric potential difference) generated by the existence of the recording medium 9 in the shaft voltage value Vs0. In the region R1, a current density in the transfer belt 11 and the urethane rubber layer 32*b* is substantially the same as the current density (target medium current density Jp) of the current that flows through the recording medium 9. Therefore, the voltage value Vin can be expressed as follows by using expression (3a):

$$Vin=(Jp-b)/a \tag{5}$$

Therefore, the shaft voltage value Vs0 can be expressed as follows by using expressions (4) and (5):

$$Vs0=(Jp-b)/a+Vp \tag{6}$$

The calculating section 57 calculates the shaft voltage value Vs0 by using expression (6).

Next, the calculating section 57 calculates the transfer current value Itr (step S34). Firstly, we will now focus on the region R2. Since both of the secondary transfer backup roller 31 and the shaft 32*a* are made of metal, the shaft voltage value Vs0 which was obtained by focusing on the region R1 in step S33 can be used even in the region R2. Since the recording medium 9 is absent in the region R2, the relational expression (expression (3a)) concerning the current density J and the shaft voltage value Vs in the case where the recording medium 9 is absent in the recording medium 9, which was obtained in step S27 can be used for the region R2. A current density Jout of a current that flows through the region R2 can be expressed as follows by using expression (3a):

$$Jout=a\times Vs0+b \tag{7}$$

The transfer current value Itr can be expressed as follows by using expression (7):

$$\begin{aligned} Itr &= Jp\times W + Jout\times(L-W) \\ &= Jp\times W + (a\times Vs0+b)\times(L-W) \end{aligned} \tag{8}$$

Here, a first term of the right side of expression (8) represents a component contributed by the region R1 in the transfer current value Itr, and a second term of the right side of expression (8) represents a component contributed by the region R2 in the transfer current value Itr. The calculating section 57 calculates the transfer current value Itr by using expression (8).

Next, the calculating section 57 calculates the transfer voltage value (initial value) Vtr which the voltage generator 56*a* should generate (step S35). As shown in FIG. 4, the voltage generator 56*a* supplies the voltage to the shaft 32*a* of the secondary transfer roller 32 through the resistance element 39. Therefore, the transfer voltage value Vtr (initial value) which the voltage generator 56*a* should generate can be expressed as follows:

$$Vtr=Vs0+R\times Itr \tag{9}$$

Here, a first term of the right side of expression (9) represents a component contributed by the transfer section 30 in the transfer voltage value Vtr, and a second term of the right side of expression (9) represents a contribution by the resistance element 39 in the transfer voltage value Vtr. The calculating section 57 calculates the transfer voltage value Vtr by using the shaft voltage value Vs0 calculated in step S33 (expression (4)), the transfer current value Itr calculated in step S34 (expression (8)), and expression (9).

As stated above, the processing flow (step S3 in FIG. 7 and FIG. 9) of the operation for calculating the transfer voltage value Vtr ends.

Next, as shown in FIG. 7, the image forming apparatus 1 starts to perform the printing operation (step S4). In this case, the voltage generator 56*a* generates the transfer voltage of the transfer voltage value Vtr obtained in step S3 on the basis of an instruction issued from the driving controller 59, and supplies (applies) the transfer voltage of the transfer voltage value Vtr to the secondary transfer roller 32 through the resistance element 39. Thereby, the current density of the current that flows through the recording medium 9 can be made to be about the same as the target medium current density Jp (approximately the same as the target medium current density Jp), and the electric potential difference (medium voltage value) between the voltage value (electric potential) of the front surface and the voltage value (electric potential) of the back surface in the recording medium 9 can be made to be about the same as the target medium voltage value Vp. Therefore, the satisfactory transfer characteristics can be obtained.

Next, the image forming apparatus 1 calculates a medium resistance value Rb (step S5).

Calculation of Medium Resistance Value Rb

Figure 11:
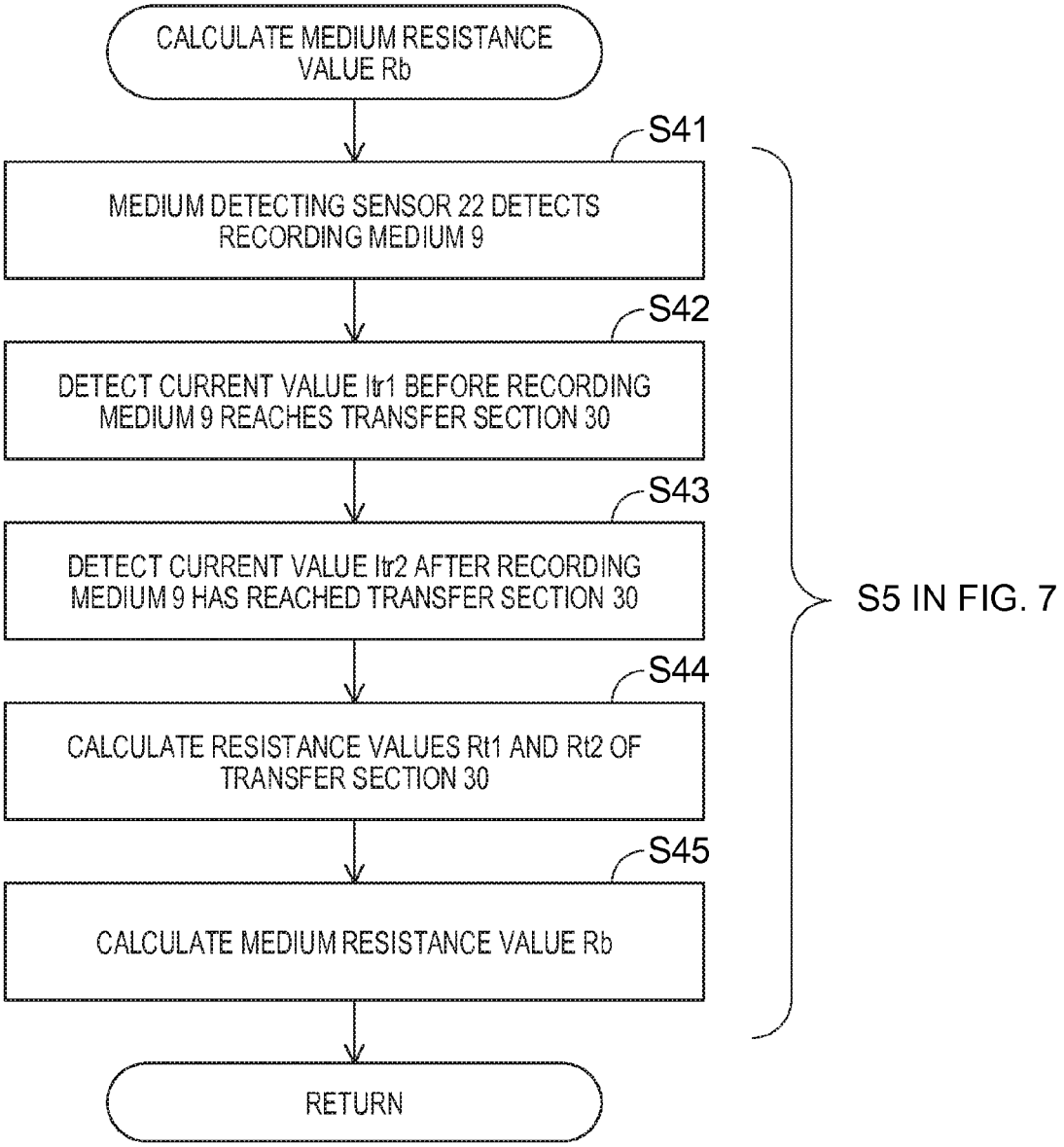
FIG. 11 is a flowchart showing an example of processing in a calculation step of a medium resistance value shown in FIG. 7.

FIG. 11 is a flowchart showing a calculation step (step S5 in FIG. 7) of the medium resistance value Rb.

Firstly, the medium detecting sensor 22 detects the recording medium 9 (step S41).

Next, the current measuring section 56*b* of the image forming apparatus 1 detects a current value Itr1 before the recording medium 9 reaches the transfer section 30 (step S42). That is to say, the image forming apparatus 1 has already started to perform the printing operation in step S4, and the voltage generator 56*a* supplies (applies) the transfer voltage of the transfer voltage value Vtr to the secondary transfer roller 32 through the resistance element 39. Therefore, the current measuring section 56*b* detects the current value Itr1 of the transfer current which flows by the transfer voltage value Vtr before the recording medium 9 reaches the transfer section 30. Furthermore, the current measuring section 56*b* supplies the detection result to the driving controller 59.

Next, the current measuring section 56*b* detects a current Itr2 of the transfer current after the recording medium 9 has reached the transfer section 30 (step S43). Furthermore, the current measuring section 56*b* supplies the detection result to the driving controller 59.

Next, the calculating section 57 calculates a resistance value (first electrical resistance value) Rt1 of the transfer section 30 in the state where the recording medium 9 is absent in the transfer section 30 (specifically, between the secondary transfer roller 32 and the secondary transfer backup roller 31), and a resistance value (third electrical resistance value) Rt2 of the transfer section 30 in the state where the recording medium 9 is present in the transfer section 30 (step S44). To be specific, the resistance values Rt1 and Rt2 of the transfer section 30 can be expressed as follows:

$$Rt1=(Vtr/Itr1)-R \tag{10a}$$

$$Rt2=(Vtr/Itr2)-R \tag{10b}$$

The calculating section 57 calculates the resistance values Rt1 and Rt2 in the transfer section 30 by using expressions (10a) and (10b).

Next, the calculating section 57 calculates the medium resistance value Rb (step S45). Firstly, we will now focus on the region R1. A resistance value Rt3 of the transfer section 30 in the region R1 can be expressed as follows by using the medium resistance value Rb, and the resistance value Rt1 of the transfer section 30 in the state where the recording medium 9 is absent in the transfer section 30:

$$Rt3=Rb+Rt1\times L/W \tag{11}$$

Here, a second term of the right side of expression (11) is a total resistance value of a resistance value of the transfer belt 11, and a resistance value of the urethane rubber layer 32*b* in the region R1. Next, we will now focus on the region R2. A resistance value Rt4 of the transfer section 30 in the region R2 can be expressed as follows by using the resistance value Rt3 of the transfer section 30 in the region R1, and the resistance value Rt2 of the transfer section 30 in the state where the recording medium 9 is present in the transfer section 30:

$$Rt4=\frac{Rt2\times Rt3}{Rt2-Rt3} \tag{12}$$

The medium resistance value Rb can be expressed as follows by expressions (11) and (12).

$$Rb = \frac{Rt2 \times Rt4}{Rt2 - Rt4} + \frac{Rt1 \times (Rt4 - Rt2)}{Rt2 - Rt4} \times \frac{L}{w} \quad (13)$$

The calculating section 57 calculates the medium resistance value Rb by using the resistance values Rt1 and Rt2 calculated in step S44 (expression (10)), the resistance value Rt4 calculated in step S45 (expression (12)), and expression (13).

From the above, the processing flow (step S5 in FIG. 7, and FIG. 11) of the calculation of the medium resistance value Rb ends.

Next, as shown in FIG. 7, the driving controller 59 of the image forming apparatus 1 confirms whether or not the printing distance M in the recording medium 9 after the printing has been started in step S4 is larger than the predetermined reference distance Mth (for example, 1 meter) (M>Mth) (step S6). When the printing distance M is equal to or smaller than the predetermined reference distance Mth (M≤Mth) ("No" in step S6), the processing flow returns back to step S6. Furthermore, step S6 is repeated until the printing distance M exceeds the predetermined reference distance Mth.

When the printing distance M is larger than the predetermined reference distance Mth ("Yes" in step S6), the driving controller 59 confirms whether or not the image forming apparatus 1 is in a state of forming the image (step S7). Furthermore, at this time, the printing distance M is set to 0 as an initial value.

Figure 12:
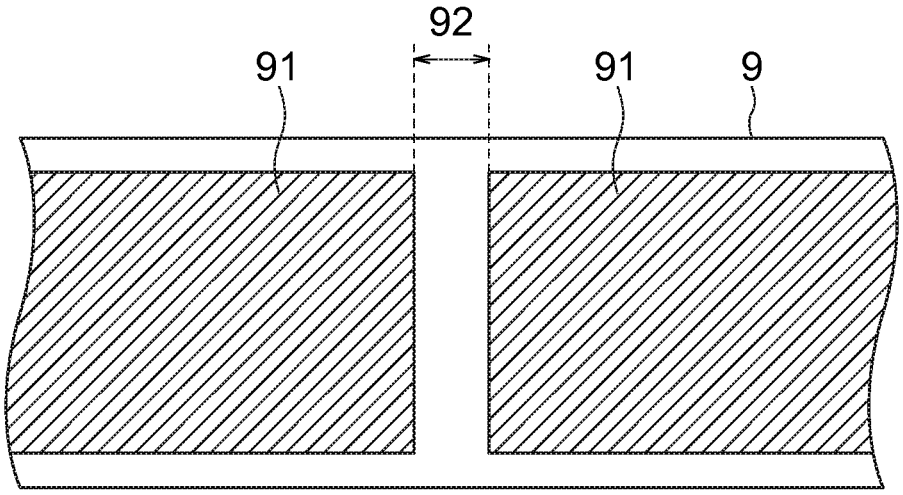
FIG. 12 is a plan view schematically showing the recording medium on which an image has been formed by the image forming apparatus shown in FIG. 1.

FIG. 12 is a plan view schematically showing the recording medium 9 on which the image has been formed by the image forming apparatus 1 shown in FIG. 1. In FIG. 12, an area 91 shows an area in which the image has been formed, while an area 92 shows an area in which no image is formed. The driving controller 59 confirms whether the transfer section 30 is performing the transfer processing (step S7). For example, in a case where the image forming apparatus 1 is forming the image (that is, in a case where the transfer section 30 is performing the transfer processing for the area 91) ("YES" in step S7), the processing flow returns back to step S7. Furthermore, step S7 is repeated until the transfer section 30 stops the transfer processing (for example, until the area 92 reaches the nip portion between the secondary transfer backup roller 31 and the secondary transfer roller 32).

Furthermore, when the transfer section 30 stops the transfer processing (for example, when the area 92 reaches the nip portion between the secondary transfer backup roller 31 and the secondary transfer roller 32) ("NO" in step S7), the image forming apparatus 1 calculates the transfer voltage value Vtr again (step S8).

Calculation of Transfer Voltage Value (Update Value) Vtr

Figure 13:
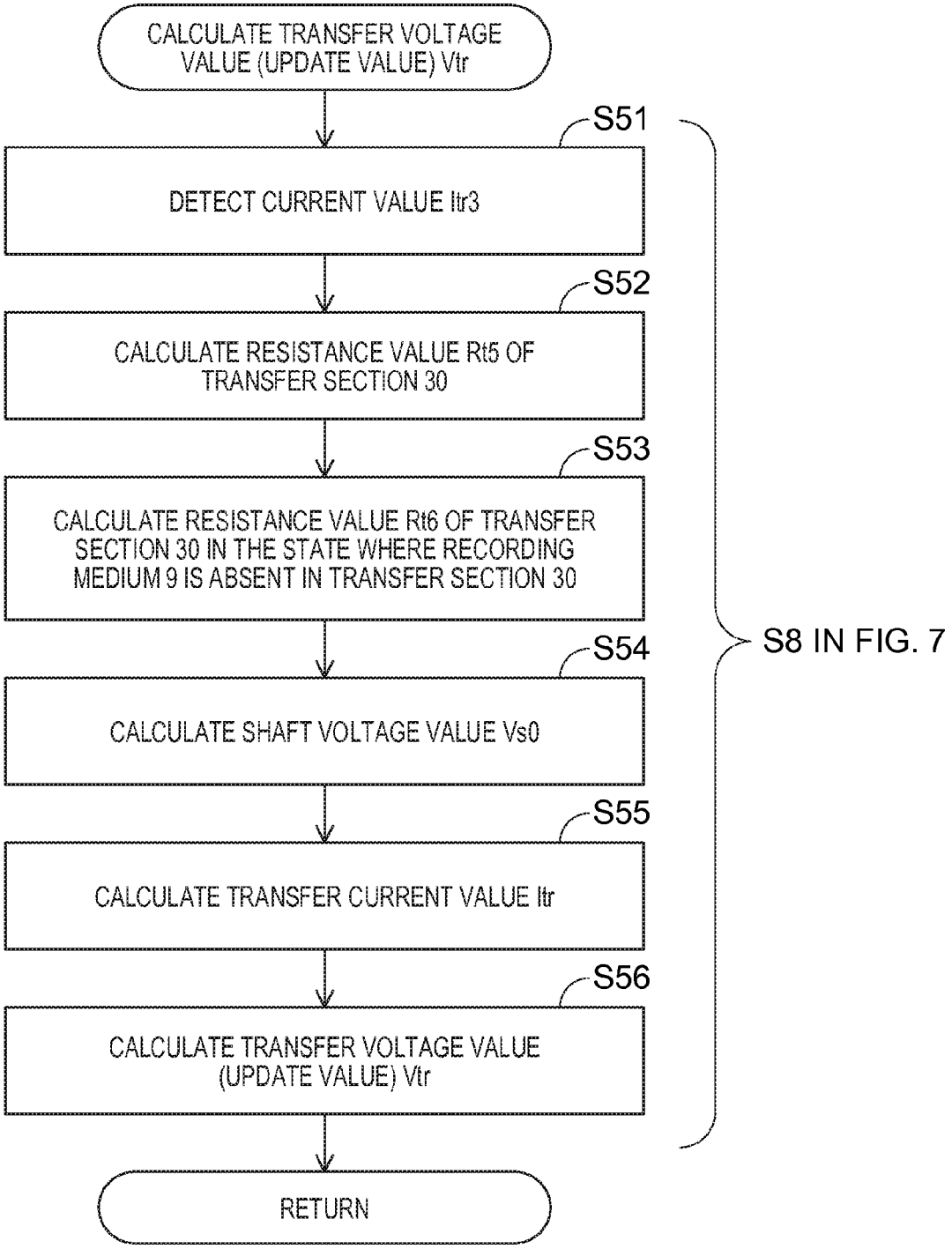
FIG. 13 is a flowchart showing an example of processing in a calculation step of the transfer voltage value (update value) shown in FIG. 7.

FIG. 13 is a flowchart showing a calculating step (step S8 in FIG. 7) of the transfer voltage value Vtr.

Firstly, the current measuring section 56*b* of the image forming apparatus 1 detects a current value Itr3 (step S51). That is to say, at this time, the voltage generator 56*a* supplies the transfer voltage value Vtr to the secondary transfer roller 32 through the resistance element 39, and the recording medium 9 has already reached the transfer section 30. Therefore, the current measuring section 56*b* detects the current value Itr3 in the state where the recording medium 9 is present in the transfer section 30. Furthermore, the current measuring section 56*b* supplies the detection result to the driving controller 59.

Next, the calculating section 57 calculates a resistance value (second electrical resistance value) Rt5 of the transfer section 30 in the state where the recording medium 9 is present in the transfer section 30 (specifically, between the secondary transfer roller 32 and the secondary transfer backup roller 31) (step S52). To be specific, the resistance value Rt5 of the transfer section 30 can be expressed as follows:

$$Rt5=(Vtr/Itr3)-R \quad (14)$$

The calculating section 57 calculates the resistance value Rt5 of the transfer section 30 by using expression (14).

Next, the calculating section 57 calculates a resistance value Rt6 of the transfer section 30 in the state where the recording medium 9 is absent in the transfer section 30 (step S53). The resistance value Rt5 of the transfer section 30 in the state where the recording medium 9 is present in the transfer section 30, and the resistance value Rt6 of the transfer section 30 in the state where the recording medium 9 is absent in the transfer section 30 have the following relationship:

$$\frac{1}{Rt5} = \frac{1}{Rb + Rt6 \times \frac{L}{W}} + \frac{1}{Rt6 \times \frac{L}{L-W}} \quad (15)$$

Here, a first term of the right side of expression (15) shows a conductance in the region R1, while a second term of the right side of expression (15) shows a conductance in the region R2. expression (15) is arranged with respect to the resistance value Rt6, thereby expression (16) is obtained:

$$L^2 \times Rt6^2 - (L^2 \times Rt5 - W \times L \times Rb) \times Rt6 + W \times (L-W) \times Rb \times Rt5 = 0 \quad (16)$$

Expression (16) is solved with respect to the resistance value Rt6, thereby expression (17) is obtained:

$$Rt6 = \frac{L^2 \times Rt5 - W \times L \times Rb \pm \sqrt{(L^2 \times Rt5 - W \times L \times Rb)^2 - 4 \times L^2 \times W \times (L-W) \times Rb \times Rt5}}{2 \times L^2} \quad (17)$$

Of two values obtained by using expression (17), the positive one is the resistance value Rt6. The calculating section 57 calculates the resistance value Rt6 of the transfer section 30 in the state where the recording medium 9 is absent in the transfer section 30 by using the medium resistance value Rb calculated in step S5 (expression (13)), the resistance value Rt5 calculated in step S52 (expression (14)), and expression (17).

Next, the calculating section 57 calculates the shaft voltage value Vs0 (step S54). When we will now focus on the region R1, the shaft voltage value Vs0 can be expressed like expression (4). When we will now focus on the region R2, the voltage Vin can be expressed as follows:

$$\begin{aligned} Vin &= Jp \times (L-W) \times Rt6 \times \frac{L}{L-W} \\ &= Jp \times Rt6 \times L \end{aligned} \quad (18)$$

Therefore, the shaft voltage value Vs0 can be expressed as follows by using expressions (4) and (18):

$$Vs0 = Vin + Vp \quad (19)$$
$$= Jp \times Rt6 \times L + Vp$$

The calculating section 57 calculates the shaft voltage value Vs0 by using the resistance value Rt6 calculated in step S53, the target medium current density Jp and the target medium voltage value Vp calculated in step S32, the medium resistance value Rb, and expression (19).

Next, the calculating section 57 calculates the transfer current value Itr (step S55). Firstly, we will now focus on the region R2. Since both the secondary transfer backup roller 31 and the shaft 32*a* are made of metal, the shaft voltage value Vs0 obtained by focusing on the region R1 in step S54 can also be used in the region R2. A current Iout that flows through the region R2 can be expressed as follows:

$$Iout = \frac{Vs0}{Rt6 \times \frac{L}{L-W}} \quad (20)$$

Therefore, the transfer current value Itr can be expressed as follows by using expression (20):

$$Itr = Jp \times W + Iout \quad (21)$$
$$= Jp \times W + \frac{Vs0}{Rt6 \times \frac{L}{L-W}}$$

Here, a first term of the right side of expression (21) shows a component contributed by the region R1 in the transfer current value Itr, while a second term of the right side of expression (21) shows a component contributed by the region R2 in the transfer current value Itr. The calculating section 57 calculates the transfer current value Itr by using the resistance value Rt6 calculated in step S53 (expression (17)), the shaft voltage value Vs0 calculated in step S54 (expression (19)), and expression (21).

Next, the calculating section 57 calculates the transfer voltage value (update value) Vtr which the voltage generator 56*a* should generate (step S56). The transfer voltage value (update value) Vtr which the voltage generator 56*a* should generate can be expressed as follows:

$$Vtr = Vs0 + R \times Itr \quad (22)$$

The calculating section 57 calculates the transfer voltage value (update value) Vtr by using the shaft voltage value Vs0 calculated in step S54 (expression (19)), the transfer current value Itr calculated in step S55 (expression (21)), and expression (22).

From the above, the processing flow (step in FIG. 7, and FIG. 13) of the operation for calculating the transfer voltage value (update value) Vtr ends.

In a period of time for which no image is formed onto the recording medium 9 (non-transfer period which is a period of time other than a period of time for which the transfer section 30 transfers the developer (toner) image onto the recording medium 9), the voltage generator 56*a* generates the transfer voltage of the transfer voltage value Vtr obtained in step S8 on the basis of the instruction issued from the driving controller 59, and supplies (applies) the transfer voltage to the secondary transfer roller 32 through the resistance element 39. Therefore, the transfer voltage value Vtr is updated for the period of time for which no image is formed. Furthermore, the image forming apparatus 1 continues the printing operation even after updating the transfer voltage value Vtr. As a result, the current density of the current that flows through the recording medium 9 can be made to be about the same as the target medium current density Jp, and the electric potential difference between the voltage value (electric potential) of the front surface and the voltage value (electric potential) of the back surface in the recording medium 9 can be made to be about the same as the target medium voltage value Vp. Therefore, the satisfactory transfer characteristics can be obtained.

In such a way, in the image forming apparatus 1, in a case where the printing distance M is longer than the predetermined reference distance Mth, the resistance value Rt5 of the transfer section 30 is obtained in the state where the recording medium 9 is present in the transfer section 30. Furthermore, the resistance value Rt6 of the transfer section 30 in the state where the recording medium 9 is absent in the transfer section 30 is obtained on the basis of the resistance value Rt5, and the transfer voltage value Vtr is obtained on the basis of the resistance value Rt6. As a result, in the image forming apparatus 1, the image quality can be enhanced. In other words, in a case where the printing is performed continuously for a long time, the resistance value of the transfer section 30 may be changed due to heat, for example. In this case, for example, the current density in the recording medium 9 may deviate from the desired target medium current density Jp, or the electric potential difference between the voltage value (electric potential) of the front surface and the voltage value (electric potential) of the back surface in the recording medium 9 may deviate from the desired target medium voltage value Vp. As a result, the transfer characteristics in the transfer section 30 become worse and, for example, the defective printing such as the blurring of characters is caused. In particular, in a case where the recording medium 9 is the rolled paper, if once the printing is started, the printing is performed continuously for a long time. Therefore, the defective printing caused by the changes of the transfer characteristics is easy to generate. In the image forming apparatus 1, in the case where (each time) the printing distance M is longer than the predetermined reference distance Mth, the resistance value Rt5 of the transfer section 30 is obtained, and the transfer voltage value Vtr for the transfer processing is obtained on the basis of the resistance value Rt5. In other words, the main controller 50 calculates the resistance value Rt5 on the basis of the current value measured by the high-voltage power source section 56 each time the transfer section 30 transfers the developer to the recording medium 9 over the predetermined reference length Mth in the conveyance direction G of the recording medium 9, and obtains the transfer voltage value Vtr on the basis of the resistance value Rt5. As a result, even when the printing is performed continuously for a long time, the current density of the current that flows through the recording medium 9 can be made to be equal or nearly equal to the target medium current density Jp, and the electric potential difference between the voltage value (electric potential) of the front surface and the voltage value (electric potential) of the back surface in the recording medium 9 can be made to be equal or nearly equal to the target medium voltage value Vp. As a result, in the image forming apparatus 1, the satisfactory transfer characteristics can be kept for a long time, and thus the image quality can be enhanced.

In addition, in the image forming apparatus 1, since for the period of time for which no image is formed, the resistance value Rt5 of the transfer section 30 is obtained, the transfer voltage value Vtr can be obtained with high accuracy. For example, when the image forming apparatus 1 is forming the image, since the toner is present in the transfer section 30, the resistance value Rt5 may be influenced by the toner. Therefore, for example, when the transfer voltage value Vtr is obtained on the basis of the resistance value Rt5, the current density in the recording medium 9 may deviate from the desired target medium current density Jp, or the electric potential difference between the voltage value (electric potential) of the front surface and the voltage value (electric potential) of the back surface in the recording medium 9 may deviate from the desired target medium voltage value Vp. In the image forming apparatus 1, the resistance value Rt5 of the transfer section 30 is obtained for the period of time for which no image is formed, and the transfer voltage value Vtr is obtained on the basis of the resistance value Rt5. In other words, the main controller 50 calculates the resistance value Rt5 on the basis of the current value measured by the high-voltage power source section 56 in the non-transfer period that is a period of time other than a period of time in which the transfer section 30 transfers the developer to the recording medium 9, and obtains the transfer voltage value Vtr on the basis of the resistance value Rt5. Therefore, the transfer voltage value Vtr can be obtained with high accuracy without being influenced by the toner. Further, the main controller 50 sets the transfer voltage value Vtr as a new voltage value for the transfer processing within the non-transfer period. As a result, in the image forming apparatus 1, the satisfactory transfer characteristics can be obtained, and thus the image quality can be enhanced.

In addition, in the image forming apparatus 1, since for the period of time for which no image is formed, the transfer voltage value Vtr is updated, the image quality can be enhanced. For example, in a case where the transfer voltage value Vtr is updated when the image forming apparatus 1 is forming the image, since the transfer characteristics are largely changed within one image, the image quality may be reduced. In the image forming apparatus 1, since for the period of time for which no image is formed, the transfer voltage value Vtr is updated, the transfer characteristics are not largely changed within one image. Therefore, the possibility that the image quality is reduced can be reduced.

As set forth hereinabove, in the present embodiment, the resistance value in the state where the recording medium 9 is present in the transfer section 30, and the transfer voltage value Vtr is obtained on the basis of that resistance value. Therefore, even when the printing is performed continuously for a long time, the image quality can be enhanced.

In addition, in the present embodiment, for the period of time for which no image is formed, the resistance value is obtained in the state where the recording medium 9 is present in the transfer section 30. Therefore, the transfer voltage value Vtr can be obtained with high accuracy, so that the image quality can be enhanced.

In addition, in the present embodiment, since for the period of time for which no image is formed, the transfer voltage value Vtr is updated, the image quality can be enhanced.

Modified Example 1

Although in the above embodiment, the toner images formed by the ID units 4, respectively, are transferred (primary transfer) onto the surface to be transferred of the transfer belt 11, and thereafter, the toner images on the surface to be transferred of the transfer belt 11 are transferred (secondary transfer) onto the surface to be transferred of the recording medium 9, the present invention is by no means limited thereto. Instead thereof, the toner images formed by the ID units 4, respectively, may be directly transferred on the surface to be transferred of the recording medium 9. In this case, the calculating section 57 may calculate the transfer voltage values in the five transfer rollers facing the five ID units 4, respectively. Further, the present invention is by no means limited thereto, and thus, for example, with respect to only a part of the five transfer rollers, the transfer voltage value(s) may be calculated by using the above method, and the transfer voltage values in the remaining transfer rollers may be roughly estimated by using the calculation results. To be specific, for example, the transfer voltage value in the transfer roller disposed on the most upstream side in the conveyance direction of the recording medium 9, and the transfer voltage value in the transfer roller disposed on the most downstream side of the five transfer rollers may be calculated by using the above described method.

Modified Example 2

Although the predetermined reference distance Mth is made to be, for example, 1 meter in the above embodiment, the present invention is by no means limited thereto. For example, the value of the predetermined reference distance Mth is changed depending on, for example, the print speed, the quality of the material of the secondary transfer roller 32, and so on. Therefore, for example, it is preferable that the value of the predetermined distance Mth be set every kind of the image forming apparatus 1.

Modified Example 3

Although the calculating section 57 obtains the transfer voltage value Vtr in the case where the printing distance M is longer than the predetermined reference distance Mth in the above embodiment, the present invention is by no means limited thereto. Instead thereof, for example, the transfer voltage value Vtr may also be obtained in the case where the temperature of the transfer section 30 (environmental temperature) is higher than a predetermined temperature. In this case, if the main controller 50 determines that the environmental temperature of the transfer section 30 detected by the environmental detector 52 is not lower than the predetermined temperature, the main controller 50 calculates the resistance value Rt5 on the basis of the current value measured by the high-voltage power source section 56. The temperature of the transfer section 30 may be estimated or detected on the basis of a detection value detected by a temperature sensor such as the environmental temperature sensor 52*a*, for example. For example, in a case where the printing is performed continuously for a long time and the temperature of the transfer section 30 becomes higher than the predetermined temperature, the calculating section 57 obtains (updates) the transfer voltage value Vtr. As a result, the image quality can be enhanced similarly to the case of the above embodiment.

Modified Example 4

Although in the above embodiment, the cutting unit 24 cuts the recording medium 9 to put the transfer section 30 in the state where the recording medium 9 is absent in the transfer section 30, the present invention is by no means limited thereto. For example, even when the recording medium 9 is used up in the rolled paper feeder 21, and thus rolled paper is replenished, the transfer section 30 is put in the state where the recording medium 9 is absent therein. Therefore, even in this case, the above technique may be applied (updating the transfer voltage value Vtr).

Modified Example 5

In the steps S31 and S 32 in FIG. 9, the processing for obtaining the target medium current density Jp and the target medium voltage value Vp is executed on the basis of the environmental temperature Ta and the environmental humidity Ha. However, in a case where only one target medium current density Jp and only one target medium voltage value Vp are stored in the storage section 58, a selecting step of the target medium current density Jp and the target medium voltage value Vp on the basis of the the environmental temperature Ta and the environmental humidity Ha may not be executed.

Modified Example 6

For example, although in the above embodiment and the above modified examples, the printing is performed on the rolled paper as the recording medium 9, the present invention is by no means limited thereto, and thus the printing may be performed on any type of medium as long as a recording medium. To be specific, for example, a so-called continuous-form paper (continuous paper) or the like in which a small-hole line is provided every predetermined length may be used as the recording medium 9.

In addition, for example, in the above embodiment and the above modified examples, the present invention is applied to a color printer. However, the present invention is by no means limited thereto, and thus instead thereof, the present invention may be applied to a monochrome printer, for example. Further, the above embodiment and the above modified examples may be applied to an image forming apparatus that transfer section (including the primary transfer rollers 7, for example) directly transfers the developer on the photosensitive body 41 onto the recording medium 9.

In addition, for example, in the above embodiment and the above modified examples, the present invention is applied to the printer. However, the present invention is by no means limited thereto, and thus instead thereof, the present invention may be applied to a Multi Function Peripheral (MFP) having functions such as a printer, a facsimile, and a scanner and so on, for example.

Although the present invention has been described so far by giving the embodiment and the modified examples thereof, the present invention is by no means limited to the embodiment and the modified examples, and various changes can be made.

What is claimed is:

1. An image forming apparatus comprising:

a transfer section including a transfer roller and a rotatable member facing the transfer roller, the transfer section performing transfer processing in which the transfer section transfers a developer to a recording medium passing between the transfer roller and the rotatable member, the recording medium being either continuous paper or rolled paper;

a voltage generator that applies a voltage to a shaft of the transfer roller;

a current measuring section that measures a current flowing through the shaft of the transfer roller and a shaft of the rotatable member when the voltage is applied to the transfer roller, the current measuring section measuring a first current between the shaft of the transfer roller and the shaft of the rotatable member in a state where the recording medium is absent between the transfer roller and the rotatable member, and a second current between the shaft of the transfer roller and the shaft of the rotatable member in a state where the recording medium is present between the transfer roller and the rotatable member, and a third current between the shaft of the transfer roller and the shaft of the rotatable member in a state where the recording medium is present between the transfer roller and the rotatable member when a predetermined time has passed after measuring the second current; and a main controller that determines a transfer voltage value for the transfer processing, wherein:

the main controller calculates a first electrical resistance value on a basis of the first current, a second electrical resistance value on a basis of the second current, a medium resistance value by using the first electrical resistance value and the second electrical resistance value, a third electrical resistance value on a basis of the third current, and a fourth electrical resistance value between the shaft of the transfer roller and the shaft of the rotatable member in a state where the recording medium is absent between the transfer roller and the rotatable member when the predetermined time has passed, by using the third electrical resistance value and the medium resistance value; and the main controller determines the transfer voltage value by using the medium resistance value and the fourth electrical resistance value.

2. The image forming apparatus according to claim 1, wherein:

the transfer section transfers the developer to the recording medium passing between the transfer roller and the rotatable member; and the main controller calculates the transfer voltage value each time the transfer section transfers the developer to the recording medium over a predetermined reference length in a conveyance direction of the recording medium.

3. The image forming apparatus according to claim 1, further comprising an environmental detector that detects at least one of an environmental temperature and an environmental humidity; wherein:

if the main controller determines that the environmental temperature of the transfer section detected by the environmental detector is not lower than a predetermined temperature, the main controller calculates the transfer voltage value.

4. The image forming apparatus according to claim 1, wherein the main controller calculates the transfer voltage value in a non-transfer period that is a period of time other than a period of time in which the transfer section transfers the developer to the recording medium.

5. The image forming apparatus according to claim 4, wherein the main controller sets the transfer voltage value as a new voltage value for the transfer processing within the non-transfer period.

6. The image forming apparatus according to claim 1, further comprising a storage section that stores a target medium current density and a target medium voltage value; wherein:

the target medium current density is a preferable current density of a current that flows through the recording medium;

the target medium voltage value is a preferable electric potential difference between an electric potential of a front surface and an electric potential of a back surface in the recording medium; and the voltage applied to the transfer roller when the first current is measured is a voltage determined from the target medium current density and the target medium voltage value.

7. The image forming apparatus according to claim 6, wherein the voltage applied to the transfer roller when the second current is measured is a voltage determined from the target medium current density and the target medium voltage value.

8. The image forming apparatus according to claim 1, wherein the main controller includes a calculating section that calculates the first electrical resistance value, the second electrical resistance value, the third electrical resistance, the fourth electrical resistance value and the medium resistance value.

9. The image forming apparatus according to claim 1, further comprising a transfer belt; wherein the transfer section transfers the developer on the transfer belt onto the recording medium.

10. The image forming apparatus according to claim 1, further comprising a photosensitive body that is capable of carrying an electrostatic latent image on a surface thereof; wherein the transfer section transfers the developer on the photosensitive body onto the recording medium.

11. An image forming method for determining a transfer voltage value in a transfer section, the transfer section including a transfer roller and a rotatable member facing the transfer roller and performing transfer processing, in which the transfer section transfers a developer to a recording medium which is either continuous paper or rolled paper passing between the transfer roller and the rotatable member, the image forming method comprising:

applying a voltage to the transfer roller;

measuring a first current between a shaft of the transfer roller and a shaft of the rotatable member with the voltage applied to the transfer roller in a state where the recording medium is absent between the transfer roller and the rotatable member;

measuring a second current between the shaft of the transfer roller and the shaft of the rotatable member with the voltage applied to the transfer roller in a state where the recording medium is present between the transfer roller and the rotatable member;

measuring a third current between the shaft of the transfer roller and the shaft of the rotatable member with the voltage applied to the transfer roller in a state where the recording medium is present between the transfer roller and the rotatable member when a predetermined time has passed after measuring the second current;

calculating a first electrical resistance value on a basis of the first current;

calculating a second electrical resistance value on a basis of the second current;

calculating a medium resistance value by using the first electrical resistance value and the second electrical resistance value;

calculating a third electrical resistance value on a basis of the third current;

calculating a fourth electrical resistance value between the shaft of the transfer roller and the shaft of the rotatable member in a state where the recording medium is absent between the transfer roller and the rotatable member when the predetermined time has passed, by using the third electrical resistance value and the medium resistance value; and determining a transfer voltage value for the transfer processing by using the medium resistance value and the fourth electrical resistance value.

* * * * *